US010245634B2

(12) United States Patent
Tanaka et al.

(10) Patent No.: US 10,245,634 B2
(45) Date of Patent: Apr. 2, 2019

(54) HAT-SHAPED CROSS-SECTION COMPONENT MANUFACTURING APPARATUS

(71) Applicant: NIPPON STEEL & SUMITOMO METAL CORPORATION, Tokyo (JP)

(72) Inventors: Yasuharu Tanaka, Tokyo (JP); Toshimitsu Aso, Tokyo (JP); Takashi Miyagi, Tokyo (JP); Misao Ogawa, Tokyo (JP); Shinobu Yamamoto, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 281 days.

(21) Appl. No.: 15/021,539

(22) PCT Filed: Sep. 18, 2014

(86) PCT No.: PCT/JP2014/074742
§ 371 (c)(1),
(2) Date: Mar. 11, 2016

(87) PCT Pub. No.: WO2015/046023
PCT Pub. Date: Apr. 2, 2015

(65) Prior Publication Data

US 2016/0221068 A1 Aug. 4, 2016

(30) Foreign Application Priority Data

Sep. 24, 2013 (JP) ..... 2013-197282

(51) Int. Cl.
*B21J 5/02* (2006.01)
*B21D 24/04* (2006.01)
(Continued)

(52) U.S. Cl.
CPC ..... *B21J 5/02* (2013.01); *B21D 22/26* (2013.01); *B21D 24/02* (2013.01); *B21D 24/04* (2013.01); *B21D 53/88* (2013.01)

(58) Field of Classification Search
CPC ..... B21J 5/02; B21J 5/022; B21J 5/025; B21J 5/06; B21D 53/88; B21D 22/02;
(Continued)

(56) References Cited

U.S. PATENT DOCUMENTS 1,606,141 A 11/1926 Brown
5,600,991 A * 2/1997 Munzen ..... B21D 22/22 72/348
(Continued)

FOREIGN PATENT DOCUMENTS

JP 59-75427 A 11/1984
JP 61-17224 U 1/1986
(Continued)

OTHER PUBLICATIONS

Machine translation JP2008105094A to Suaganuma et al. May 2008 is attached.*
(Continued)

*Primary Examiner* — Peter Dungba Vo
*Assistant Examiner* — Joshua D Anderson
(74) *Attorney, Agent, or Firm* — Birch, Stewart, Kolasch & Birch, LLP

(57) ABSTRACT

A hat-shaped cross-section component manufacturing apparatus includes: a die that includes a forming face that grips and presses a metal stock sheet; a blank holder, that includes a forming face that grips and presses the metal stock sheet so as to configure a forming face corresponding to the forming face of the die, a pad that is disposed inside the opening formed in the die, and that includes a forming face that grips and presses the metal stock sheet; and a punch that
(Continued)

is disposed facing the pad and that includes a forming face that grips and presses the metal stock sheet so as to configure a forming face corresponding to the forming face of the pad. The hat-shaped cross-section component manufacturing apparatus further includes a pressure limiting device that limits a formed curving component from being pressed between the pad and the blank holder during demolding.

4 Claims, 50 Drawing Sheets

(51) Int. Cl.
*B21D 24/02* (2006.01)
*B21D 22/26* (2006.01)
*B21D 53/88* (2006.01)

(58) Field of Classification Search
CPC ..... B21D 22/26; B21D 22/30; B21D 24/02; B21D 24/04; B21D 5/01; B21D 24/06; B21D 24/82; B62D 25/08
See application file for complete search history.

(56) References Cited

U.S. PATENT DOCUMENTS

| | | | |
|---|---|---|---|
| 2005/0262917 | A1 | 12/2005 | Osumi et al. |
| 2009/0245946 | A1 | 10/2009 | Maeda |
| 2010/0096765 | A1 | 4/2010 | Kuwayama et al. |
| 2012/0297853 | A1 | 11/2012 | Tanaka et al. |
| 2014/0182349 | A1 | 7/2014 | Yonemura et al. |
| 2015/0224563 | A1 | 8/2015 | Aso et al. |

FOREIGN PATENT DOCUMENTS

| | | | | |
|---|---|---|---|---|
| JP | 2-48216 | U | | 4/1990 |
| JP | 7-230762 | A | | 8/1995 |
| JP | 2003-103306 | A | | 4/2003 |
| JP | 2004-154859 | A | | 6/2004 |
| JP | 2006-15404 | A | | 1/2006 |
| JP | 2008105094 | A | * | 5/2008 |
| JP | 2008-307557 | A | | 12/2008 |
| JP | 2009-241190 | A | | 10/2009 |
| KR | 20-1998-0006868 | U | | 4/1998 |
| TW | I330556 | B | | 9/2010 |
| TW | 201206585 | A1 | | 2/2012 |
| TW | 201302343 | A1 | | 1/2013 |
| WO | WO 2014/042067 | A1 | | 3/2014 |

OTHER PUBLICATIONS

Original document merged with translated abstract JP2008105094A to Suaganuma et al. May 2008 is attached.*
Machine translation JP2008105094A to Suganuma May 2008 from ESPACENET is attached.*
Korean Office Action, dated Jun. 19, 2017, for corresponding Korean Application No. 10-2016-7006137, with an English translation.
International Search Report, issued in PCT/JP2014/074742, dated Dec. 16, 2014.
Office Action, issued in TW 103132445, dated Feb. 3, 2016.
Office Written Opinion of the International Searching Authority, issued in PCT/JP2014/074742 (PCT/ISA/234), dated Dec. 16, 2014.
Japanese Notice of Reasons for Rejection for Japanese Application No. 2015-539155, dated Nov. 22, 2016, with an English translation thereof.

* cited by examiner

FORMING COMPLETE

DURING DEMOLDING

DURING DEMOLDING

DEMOLDING COMPLETE

FORMING COMPLETE

DURING DEMOLDING

DEMOLDING COMPLETE

FORMING IN PROGRESS

FORMING COMPLETE

DURING DEMOLDING

DEMOLDING COMPLETE

CROSS-SECTION AA

HAT-SHAPED CROSS-SECTION COMPONENT MANUFACTURING APPARATUS

TECHNICAL FIELD

The present invention relates to a hat-shaped cross-section component manufacturing apparatus for manufacturing a component with a hat-shaped cross-section.

BACKGROUND ART

Pressed components with a hat-shaped cross-section profile (also referred to as "hat-shaped cross-section components" in the present specification), such as front side members, are known structural members configuring automotive vehicle body framework. Such hat-shaped cross-section components are formed by performing press working (drawing) or the like on metal sheet materials (for example, steel sheets) (see, for example, Japanese Patent Application Laid-Open (JP-A) Nos. 2003-103306, 2004-154859, 2006-015404, and 2008-307557).

SUMMARY OF INVENTION

Technical Problem

When a hat-shaped cross-section component is formed by drawing a metal sheet, it is important to remove the hat-shaped cross-section component during demolding while avoiding deformation as much as possible.

In consideration of the above circumstances, an object of the present invention is to obtain a hat-shaped cross-section component manufacturing apparatus capable of suppressing deformation of a hat-shaped cross-section component during demolding.

Solution to Problem

A hat-shaped cross-section component manufacturing apparatus that addresses the above issue includes: a die that includes a forming face that presses both side portions of a metal sheet, and that includes an opening; a punch that is disposed facing the opening of the die, wherein the punch is disposed inside the opening when a mold is closed, and wherein the punch includes a forming face that presses a central portion of the metal sheet; a pad that is disposed inside the opening formed in the die, wherein the pad includes a forming face that presses and grips the central portion of the metal sheet against the punch when the mold is closed so as to configure a forming face corresponding to the forming face of the punch; a holder that is disposed facing the die, wherein the holder includes a forming face that presses and grips both side portions of the metal sheet against the die when the mold is closed so as to configure a forming face corresponding to the forming face of the die; and a pressure limiting device that limits a formed hat-shaped cross-section component with a hat-shaped cross-section profile from being pressed between the pad and the holder during demolding.

The hat-shaped cross-section component manufacturing apparatus that addresses the above issue forms the hat-shaped cross-section component that has a hat-shaped cross-section profile by gripping the central portion of the metal sheet with the punch and the pad, gripping the both side portions of the metal sheet with the die and the holder, and moving the holder and die, and the punch and pad, up-down relative to each other. The hat-shaped cross-section component is removed from the mold (the holder, the die, the punch, and the pad) in a state in which the pressure limiting device limits the formed hat-shaped cross-section component from being pressed between the pad and the holder during demolding. Deformation of the hat-shaped cross-section component during demolding is accordingly suppressed.

Advantageous Effects of Invention

The hat-shaped cross-section component manufacturing apparatus of the present invention exhibits the excellent advantageous effect of enabling deformation of a hat-shaped cross-section component during demolding to be suppressed.

DESCRIPTION OF EMBODIMENTS

Explanation follows regarding a hat-shaped cross-section component manufacturing apparatus according to an exemplary embodiment of the present invention. First, explanation follows regarding configuration of a hat-shaped cross-section component, followed by explanation regarding the hat-shaped cross-section component manufacturing apparatus.

Hat-Shaped Cross-Section Component Configuration

FIG. 1A to FIG. 1D and FIG. 2 illustrate a curving component 10, serving as a hat-shaped cross-section component manufactured by drawing using a hat-shaped cross-section component manufacturing apparatus 500 (see FIG. 5) of the present exemplary embodiment. As illustrated in these drawings, the curving component 10 includes a top plate 11 extending along the length direction, and vertical walls 12*a*, 12*b*, that respectively bend and extend from both short end direction sides of the top plate 11 toward one side in the thickness direction of the top plate 11. The curving component 10 further includes an outward extending flange 13*a* that bends from an end of the vertical wall 12*a* on the opposite side to the top plate 11, and extends toward the side away from the vertical wall 12*b*, and an outward extending flange 13*b* that bends at an end of the vertical wall 12*b* on the opposite side to the top plate 11, and extends toward the side away from the vertical wall 12*a*.

Ridge lines 14*a*, 14*b* are formed extending along the length direction of the curving component 10 between the top plate 11 and the respective vertical walls 12*a*, 12*b*. Concave lines 15*a*, 15*b* are formed extending along the length direction of the curving component 10 between the respective vertical walls 12*a*, 12*b* and outward extending flanges 13*a*, 13*b*.

The ridge lines 14*a*, 14*b* and the concave lines 15*a*, 15*b* are provided extending substantially parallel to each other. Namely, the height of the vertical walls 12*a*, 12*b* from the respective outward extending flanges 13*a*, 13*b* is substantially uniform along the length direction of the curving component 10.

Figure 1A:
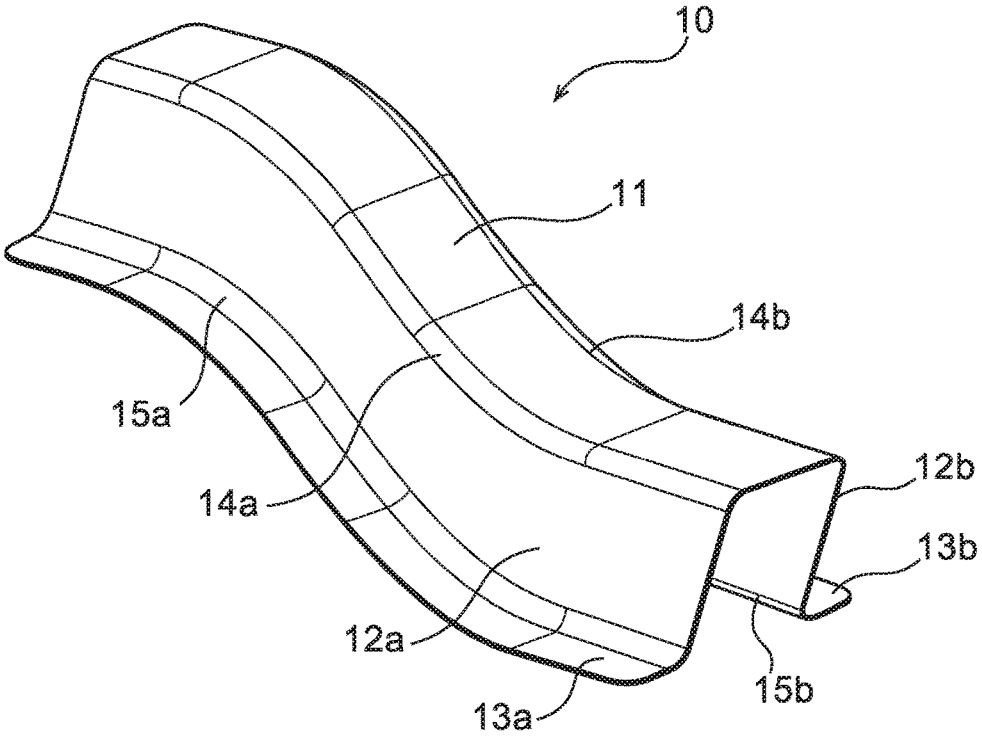
FIG. 1A is a perspective view illustrating an example of a curving component configured with a hat-shaped cross-section.
Figure 1B:
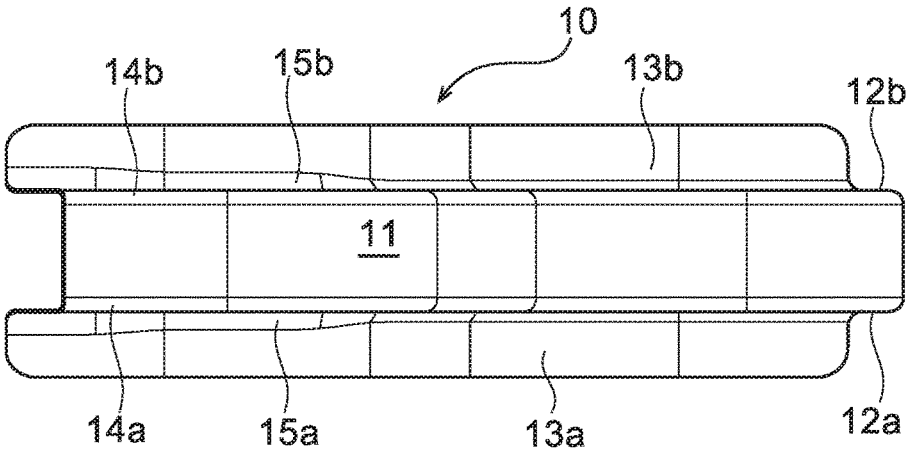
FIG. 1B is a plan view of the curving component illustrated in FIG. 1A, as viewed from above.
Figure 1C:
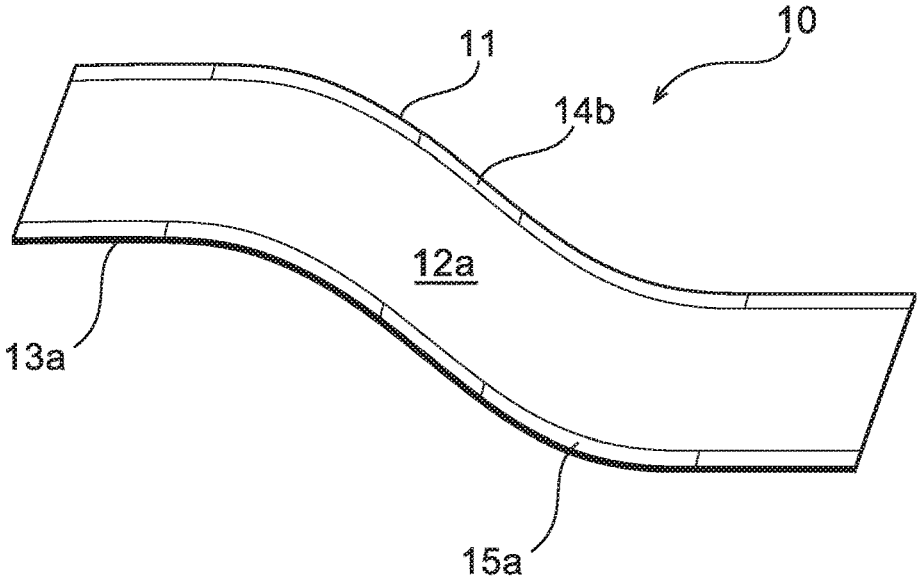
FIG. 1C is a front view of the curving component illustrated in FIG. 1A.
Figure 1D:
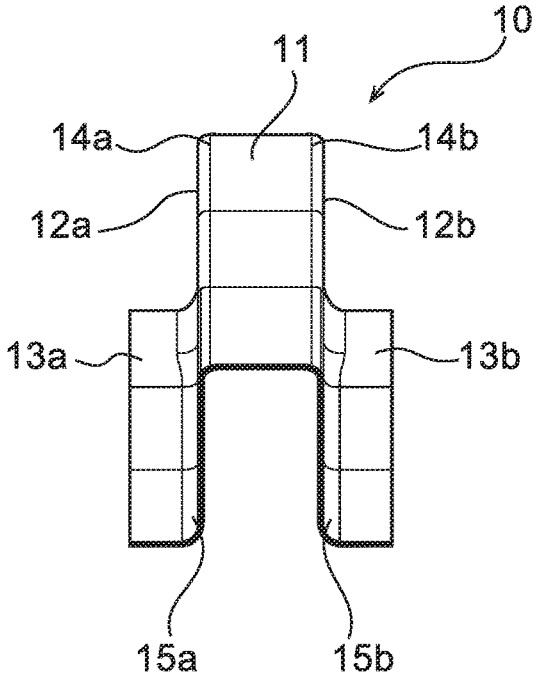
FIG. 1D is a side view of the curving component illustrated in FIG. 1A, as viewed from one end portion.
Figure 2:
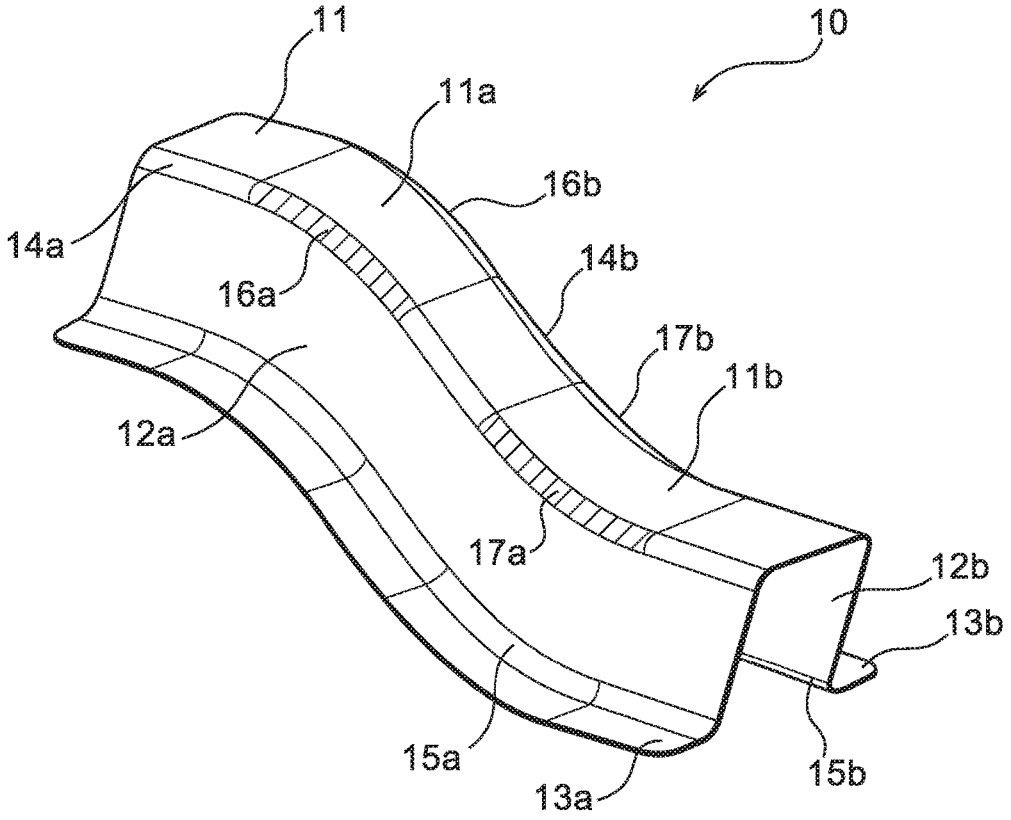
FIG. 2 is a perspective view corresponding to FIG. 1A, illustrating a curving component in order to explain ridge lines at locations corresponding to a concave shaped curved portion and a convex shaped curved portion.

As illustrated in FIG. 2, a portion of the top plate 11 is formed with a convex shaped curved portion 11*a* that curves in an arc shape toward the outside of the lateral cross-section profile of the hat shape, namely toward the outer surface side of the top plate 11. Another portion of the top plate 11 is formed with a concave shaped curved portion 11*b* that curves in an arc shape toward the inside of the lateral cross-section profile of the hat shape, namely toward the inner surface side of the top plate 11. The ridge lines 14*a*, 14*b* formed by the top plate 11 and the vertical walls 12*a*, 12*b* at the convex shaped curved portion 11*a* and the concave shaped curved portion 11*b* are also curved in arc shapes at locations 16*a*, 16*b*, and 17*a*, 17*b*, corresponding to the convex shaped curved portion 11*a* and the concave shaped curved portion 11*b*. Note that an "arc shape" is not limited to part of a perfect circle, and may be part of another curved line, such as of an ellipse, a hyperbola, or a sine wave.

Figure 3A:
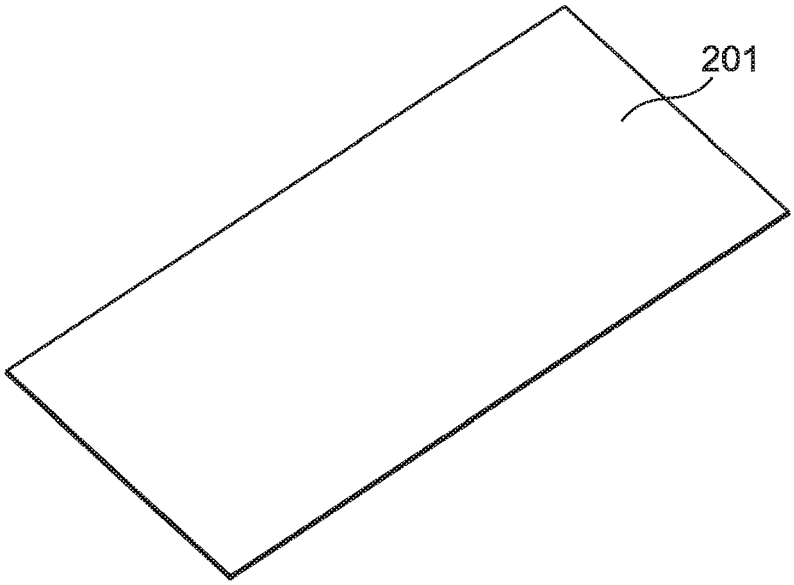
FIG. 3A is a perspective view illustrating a metal stock sheet before forming.
Figure 3B:
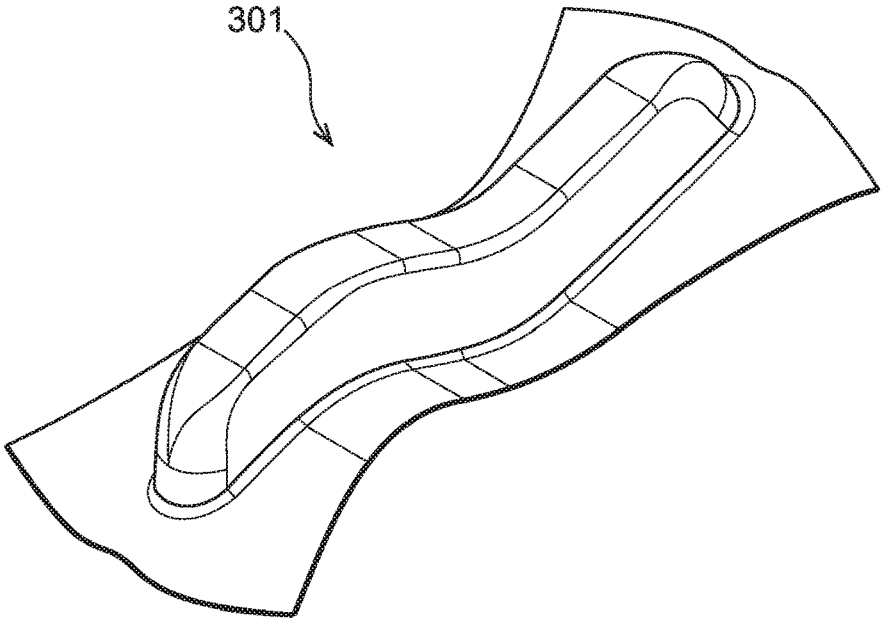
FIG. 3B is a perspective view illustrating a drawn panel.

The curving component 10 described above is formed by forming a drawn panel 301, illustrated in FIG. 3B, by drawing a rectangular shaped metal stock sheet 201, serving as a metal sheet, illustrated in FIG. 3A, and then trimming unwanted portions of the drawn panel 301.

Figure 4:
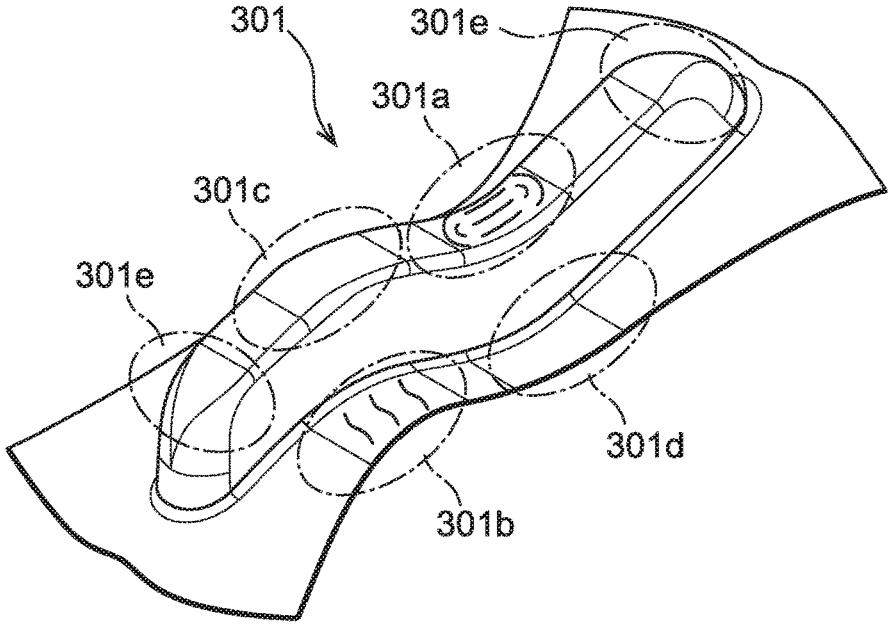
FIG. 4 is a perspective view corresponding to FIG. 3B, illustrating locations in the drawn panel where cracks and creases are liable to occur.

However, when the curving component 10 with a hat-shaped cross-section is manufactured by drawing, as illustrated in FIG. 4, excess material is present at a concave shaped curved portion top plate 301*a* and a convex shaped curved portion flange 301*b* of the drawn panel 301 at the stage of forming the drawn panel 301, and creases are liable to occur. Increasing restraint at the periphery of the metal stock sheet 201 during the forming process by, for example, raising the pressing force of a blank holder, or by adding locations for forming draw beads to the blank holder, thereby suppressing inflow of the metal stock sheet 201 into the blank holder, is known to be effective in suppressing the occurrence of creases.

However, when there is increased suppression of inflow of the metal stock sheet 201 into the blank holder, there is a large reduction in the sheet thickness of the drawn panel 301 at respective portions including a convex shaped curved portion top plate 301*c*, a concave shaped curved portion flange 301*d*, and both length direction end portions 301*e*, 301*e*. In examples in which the metal stock sheet 201 is a material with particularly low extensibility (for example high tensile steel), it is conceivable that cracking could occur at these respective portions.

Accordingly, in order to avoid creasing and cracking in the manufacture of curved components with a hat-shaped cross-section, such as front side members configuring part of a vehicle body framework, by pressing using drawing, it has been difficult to employ high strength materials with low extensibility as the metal stock sheet 201, meaning that low strength materials with high extensibility have had to be employed.

However, the occurrence of such creasing and cracking can be suppressed through a curving component manufacturing process, described later, employing the hat-shaped cross-section component manufacturing apparatus 500 of the present exemplary embodiment.

Hat-Shaped Cross-Section Component Manufacturing Apparatus Configuration

Figure 5:
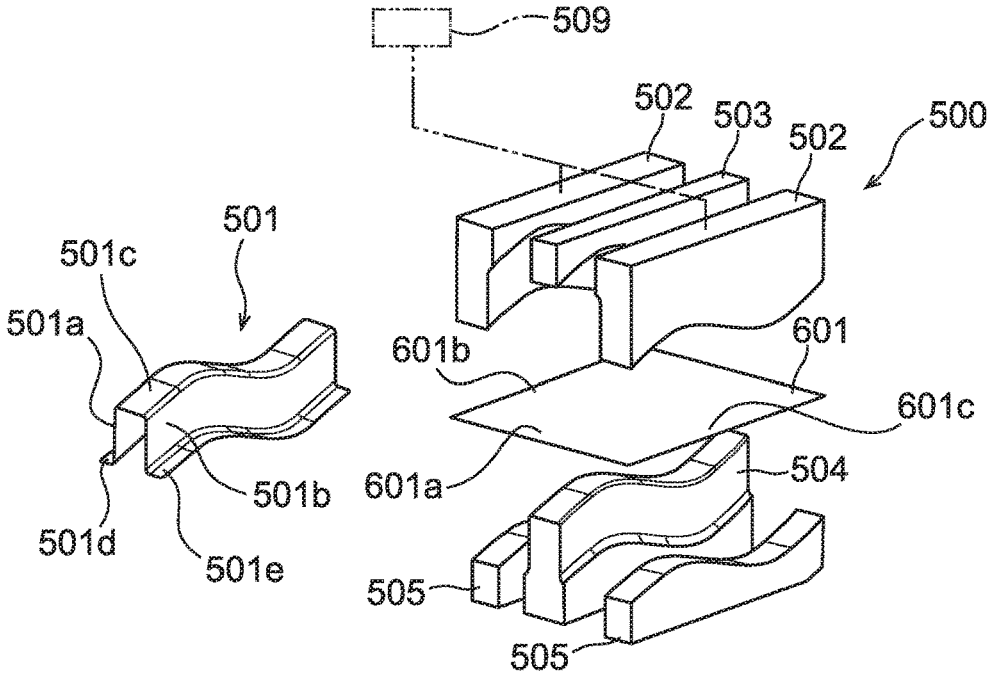
FIG. 5 is an exploded perspective view illustrating relevant portions of a hat-shaped cross-section component manufacturing apparatus.
Figure 6A:
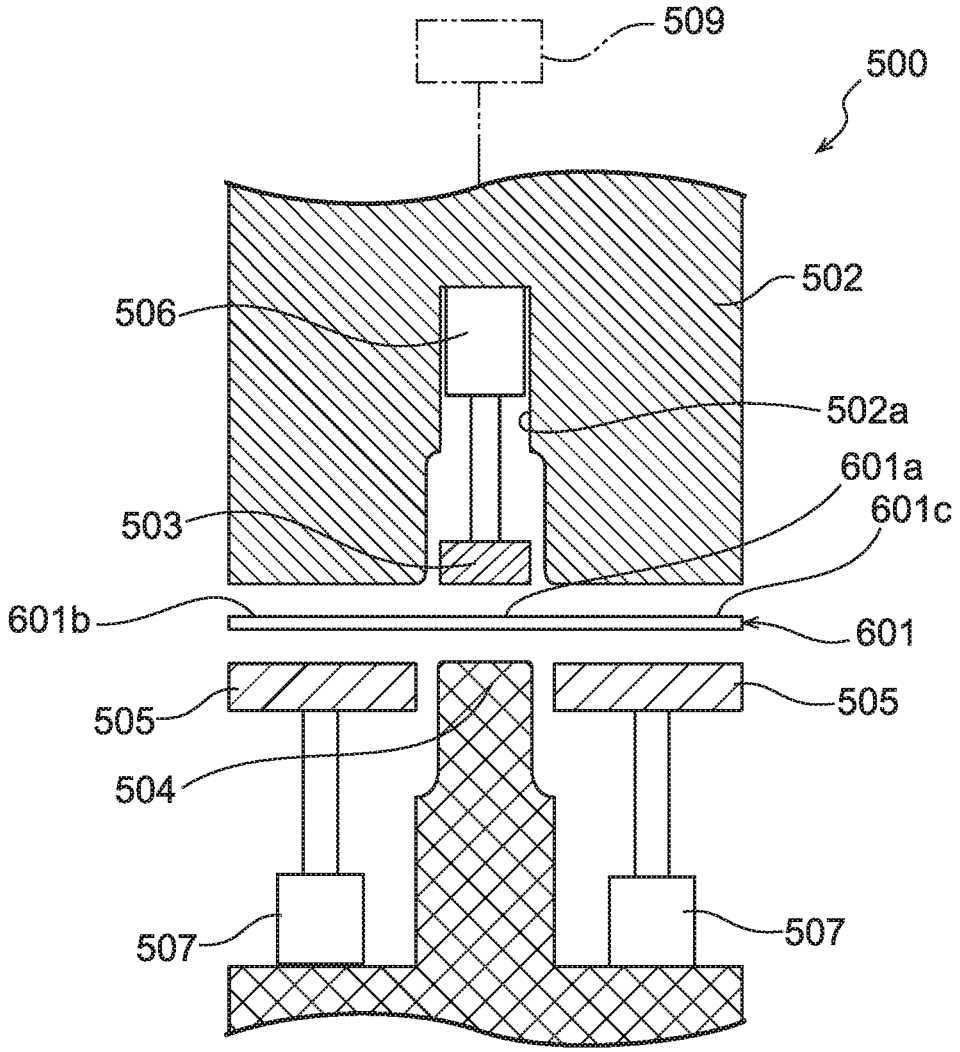
FIG. 6A is a cross-section illustrating a stage at the start of processing of the hat-shaped cross-section component manufacturing apparatus illustrated in FIG. 5.
Figure 6B:
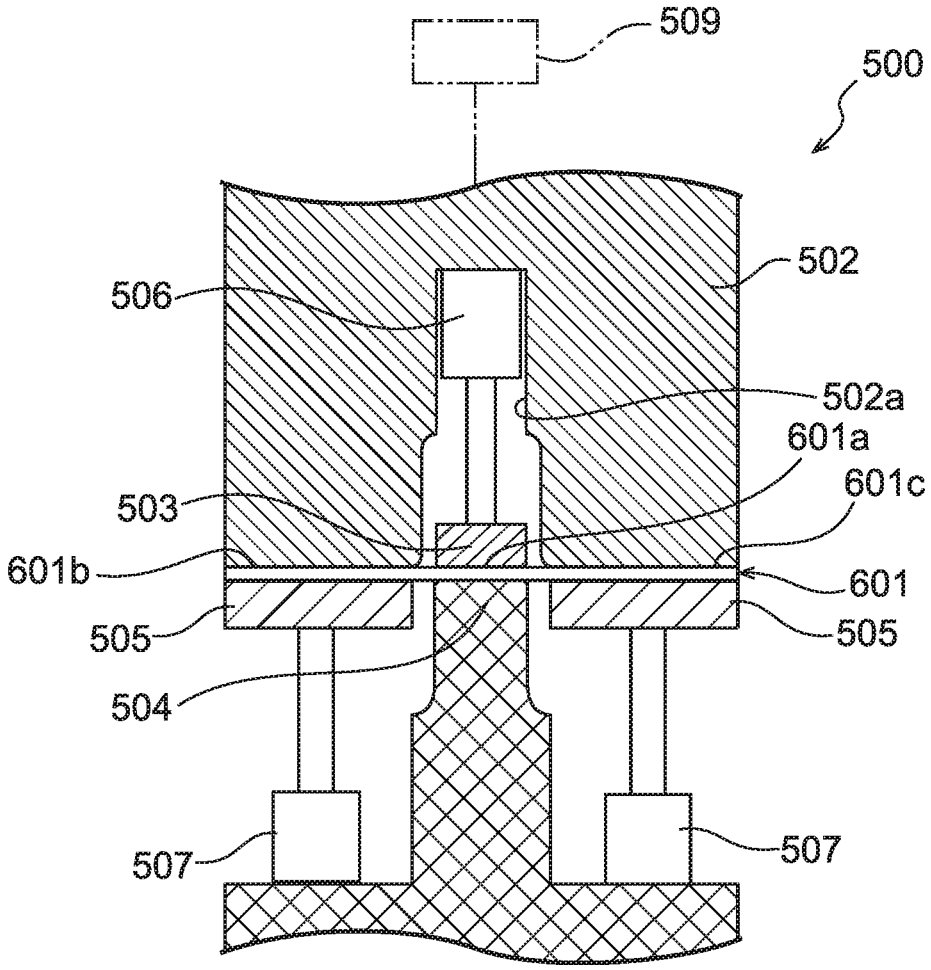
FIG. 6B is a cross-section illustrating the hat-shaped cross-section component manufacturing apparatus illustrated in FIG. 5 at a stage at which a metal stock sheet is gripped and restrained between a die and pad, and a holder and a punch.
Figure 6C:
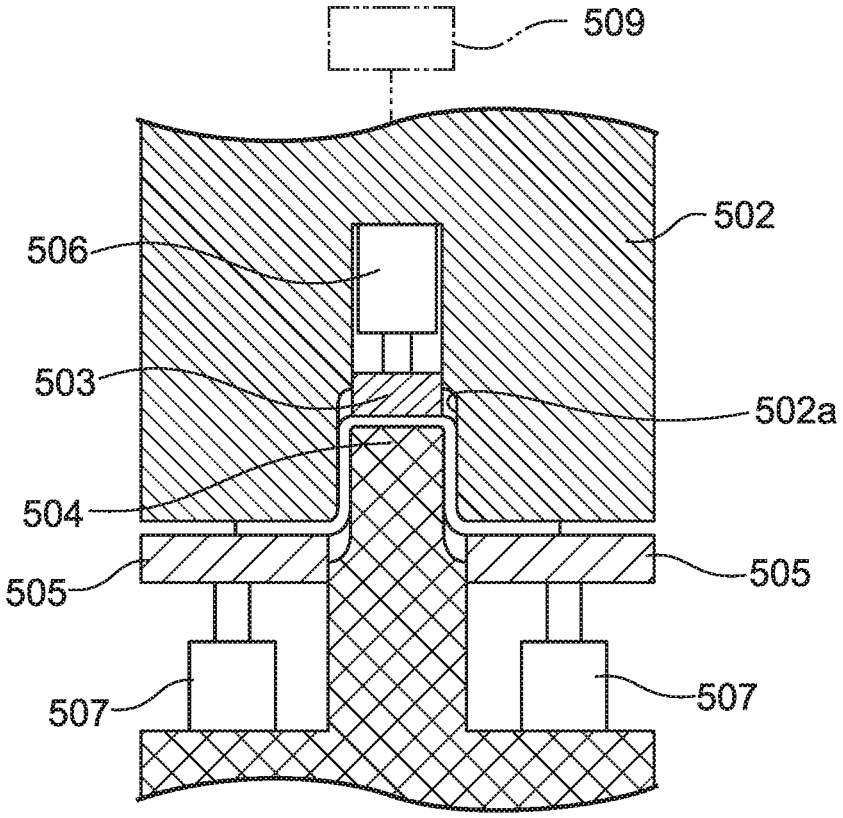
FIG. 6C is a cross-section illustrating a stage at which the punch has been pushed in from the stage illustrated in FIG. 6B.
Figure 6D:
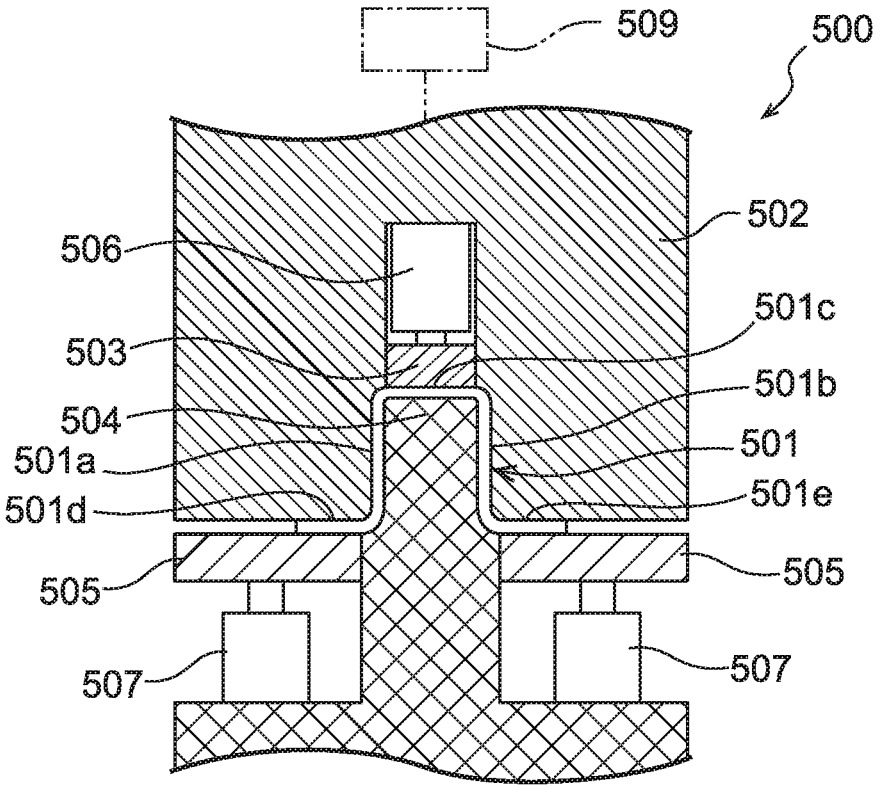
FIG. 6D is a cross-section illustrating a state in which the punch has been pushed in further from the stage illustrated in FIG. 6C, such that the punch has been fully pushed in with respect to the die.

FIG. 5 is an exploded perspective view of the hat-shaped cross-section component manufacturing apparatus 500 employed to manufacture a curving component 501, serving as a hat-shaped cross-section component. Note that configuration of the curving component 501 is substantially the same as the configuration of the curving component 10 (see FIG. 1A). FIG. 6A is a cross-section illustrating the manufacturing apparatus illustrated in FIG. 5 at the start of processing. FIG. 6B is a cross-section illustrating the manufacturing apparatus illustrated in FIG. 5 at a stage at which a metal stock sheet 601 is gripped and restrained between a die 502 and pad 503, and a holder 505 and punch 504. FIG. 6C is a cross-section illustrating a stage at which the punch 504 has been pushed in from the stage illustrated in FIG. 6B. FIG. 6D is a cross-section illustrating a state in which the punch 504 has been pushed in further from the stage illustrated in FIG. 6C, such that the punch 504 has been fully pushed in with respect to the die 502.

As illustrated in FIG. 5, the hat-shaped cross-section component manufacturing apparatus 500 includes the die 502 that has a shape including respective outer surface side profiles of vertical walls 501*a*, 501*b*, and outward extending flanges 501*d*, 501*e* of the curving component 501, the pad 503 that has a shape including the outer surface side profile of a top plate 501*c*, the punch 504 that is disposed facing the die 502 and the pad 503 and that has a shape including respective inner surface side profiles of the top plate 501*c* and the vertical walls 501*a*, 501*b* of the curving component 501, and a blank holder 505, serving as a holder, with a shape including inner surface side profiles of the outward extending flanges 501*d*, 501*e*.

As illustrated in FIG. 6A to FIG. 6D, the die 502 is disposed at an upper side of the punch 504, and a central portion in the short direction (the left-right direction on the page) of the die 502 is formed with an opening 502*a* opening toward the punch 504 side. Inner walls of the opening 502*a* of the die 502 configure forming faces including the profile of the outer surfaces of the vertical walls 501*a*, 501*b* (see FIG. 5) of the curving component 501. Moreover, end faces on the blank holder 505 side of both die 502 short direction side portions configure forming faces including the profile of the faces on the vertical wall 501*a*, 501*b* sides of the outward extending flanges 501*d*, 501*e* of the curving component 501 (see FIG. 5). A pad press device 506, described later, is fixed to the closed end (upper end) of the opening 502*a* formed in the die 502. Moreover, the die 502 is coupled to a mover device 509 such as a gas cushion, a hydraulic device, a spring, or an electric drive device. Actuating the mover device 509 enables up-down direction movement of the die 502.

The pad 503 is disposed inside the opening 502*a* formed in the die 502. The pad 503 is coupled to the pad press device 506, this being a gas cushion, a hydraulic device, a spring, an electric drive device, or the like. A face on the die 502 side of the pad 503 configures a forming face including the profile of the outer surface of the top plate 501*c* (see FIG. 5) of the curving component 501. When the pad press device 506 is actuated, the pad 503 is pressed toward the punch 504 side, and a central portion 601*a* in the short direction (the left-right direction on the page) of the metal stock sheet 601 is pressed and gripped between the pad 503 and the punch 504.

The punch 504 is formed by a protruding shape toward the pad 503 side at a location in the lower mold that faces the pad 503 in the up-down direction. Blank holder press devices 507, described later, are fixed at the sides of the punch 504. Outer faces of the punch 504 configure forming faces including the profile of the inner surfaces of the vertical walls 501*a*, 501*b* and the top plate 501*c* (see FIG. 5) of the curving component 501.

The blank holder 505 is coupled to the blank holder press devices 507, serving as holder press devices, these being gas cushions, hydraulic devices, springs, electric drive devices, or the like. Die 502 side end faces the blank holder 505 configure forming faces including the profile of faces of the outward extending flanges 501*d*, 501*e* of the curving component 501 on the opposite side to the vertical walls 501*a*, 501*b* (see FIG. 5). When the blank holder press devices 507 are actuated, the blank holder 505 is pressed toward the die 502 side, and both short direction side portions 601*b*, 601*c* of the metal stock sheet 601 are pressed and gripped.

Next, explanation follows regarding a pressing process of the metal stock sheet 601 by the hat-shaped cross-section component manufacturing apparatus 500 described above.

First, as illustrated in FIG. 6A, the metal stock sheet 601 is disposed between the die 502 and pad 503, and the punch 504 and blank holder 505.

Next, as illustrated in FIG. 6B, the central portion 601*a* of the metal stock sheet 601, namely a portion of the metal stock sheet 601 that will form the top plate 501*c* (see FIG. 5), is pressed against the punch 504 by the pad 503, and pressed and gripped between the two. Both side portions 601*b*, 601*c* of the metal stock sheet 601, namely respective portions of the metal stock sheet 601 that will form the vertical walls 501*a*, 501*b* and the outward extending flanges 501*d*, 501*e* (see FIG. 5), are pressed against the die 502 by the blank holder 505, and are pressed and gripped between the two.

The pad press device 506 and the blank holder press devices 507 are actuated, such that the central portion 601*a* and both side portions 601*b*, 601*c* of the metal stock sheet 601 are pressed with a specific pressing force and gripped. The central portion 601*a* and both side portions 601*b*, 601*c* of the metal stock sheet 601 are formed into curved profiles to follow the curved profiles of the pressing curved faces as a result.

In this state, the mover device 509 is actuated, and the blank holder 505 and the die 502 are moved relatively in a direction away from the die 502 toward the blank holder 505 (toward the lower side), thereby forming the curving component 501. The pad press device 506 and the blank holder press devices 507 retract in the up-down direction accompanying lowering of the die 502. When the pad press device 506 and the blank holder press devices 507 retract in the up-down direction, the central portion 601*a* and both side portions 601*b*, 601*c* of the metal stock sheet 601 are pressed with a specific pressing force.

As illustrated in FIG. 6C, the metal stock sheet 601 gripped between the die 502 and the blank holders 505 flows into the opening 502*a* between the punch 504 and the die 502 accompanying the movement of the blank holder 505 and the die 502, thereby forming the vertical walls 501*a*, 501*b* (see FIG. 5).

Then, as illustrated in FIG. 6D, the blank holder 505 and the die 502 move by a specific distance, and forming is completed at the point when the height of the vertical walls 501*a*, 501*b* reaches a specific height.

Note that in the example illustrated in FIG. 6A to FIG. 6D, the curving component 501 is formed by moving the blank holder 505 and the die 502 in a stationary state of the punch 504 and the pad 503. However, the present invention is not limited thereto, and the curving component 501 may be formed in the following manner.

Figure 7:
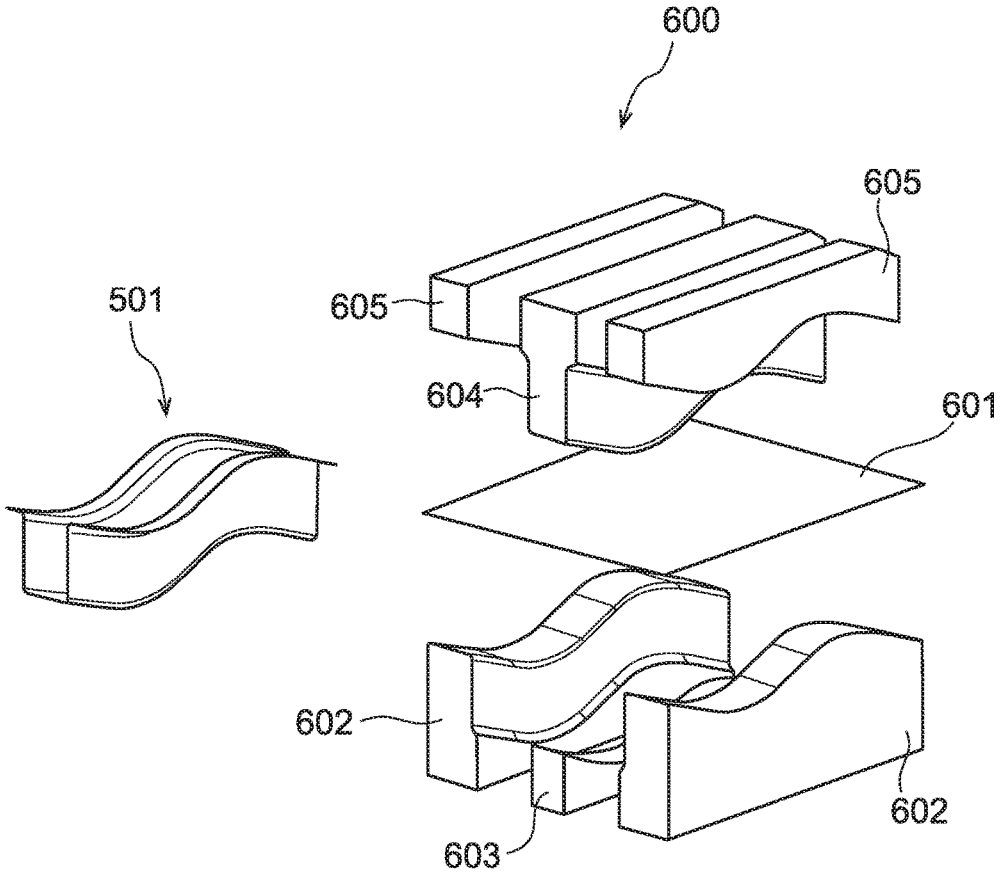
FIG. 7 is an exploded perspective view illustrating another hat-shaped cross-section component manufacturing apparatus.
Figure 8A:
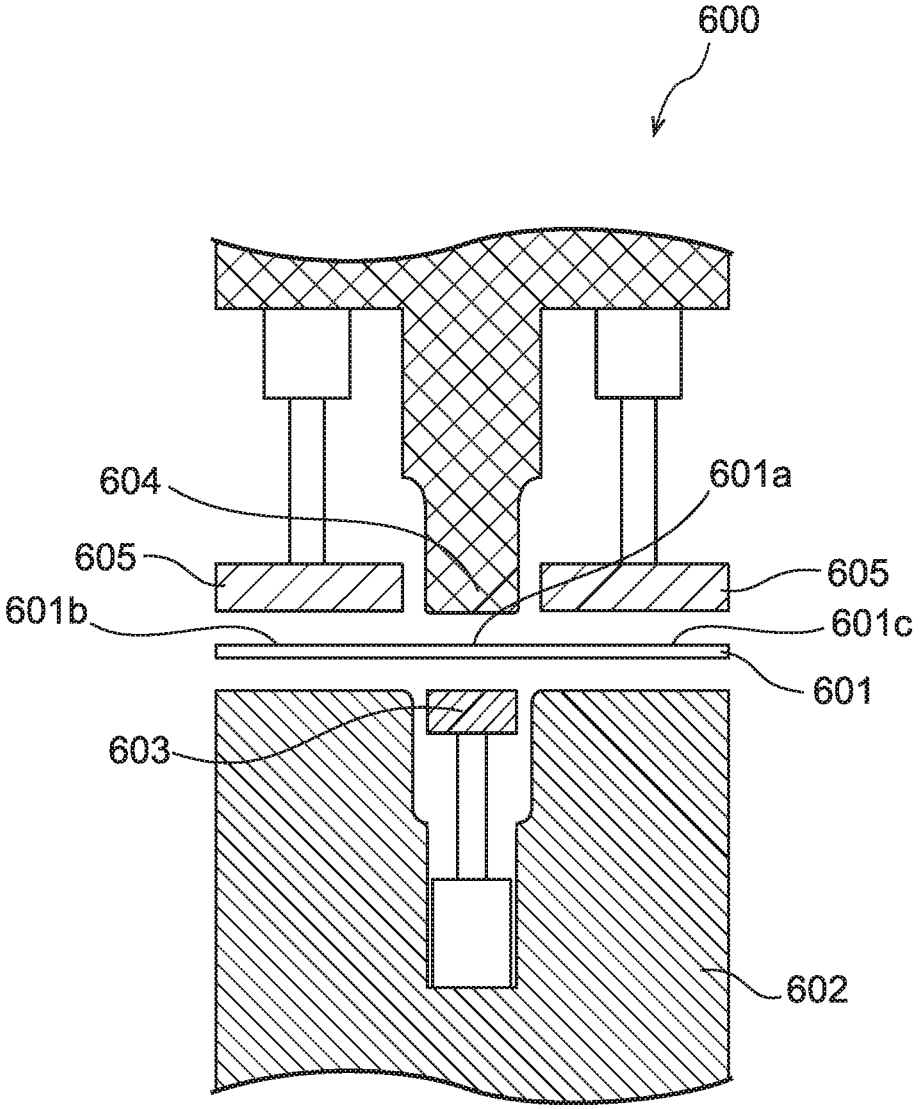
FIG. 8A is a cross-section illustrating the hat-shaped cross-section component manufacturing apparatus illustrated in FIG. 7, at a stage at the start of processing.
Figure 8B:
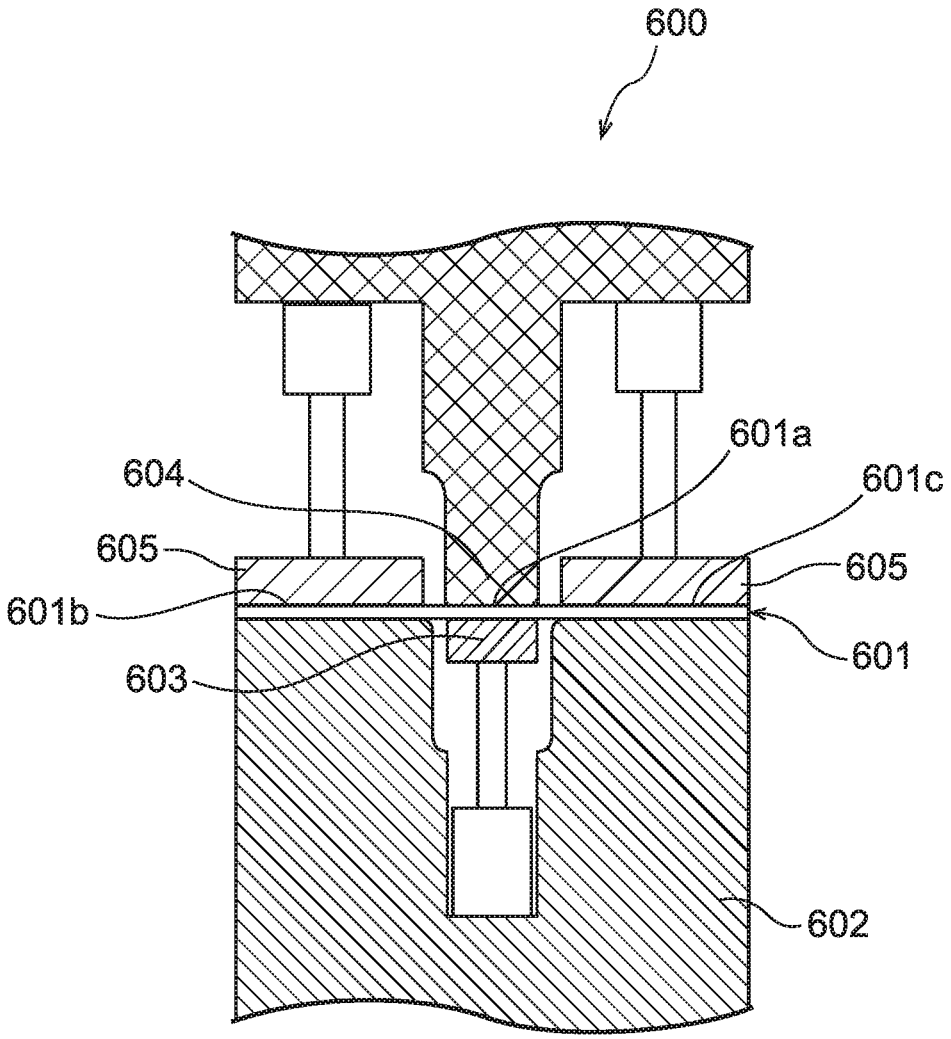
FIG. 8B is a cross-section illustrating a stage at which the metal stock sheet is gripped and restrained between a die and pad, and a holder and punch of the hat-shaped cross-section component manufacturing apparatus illustrated in FIG. 7.
Figure 8C:
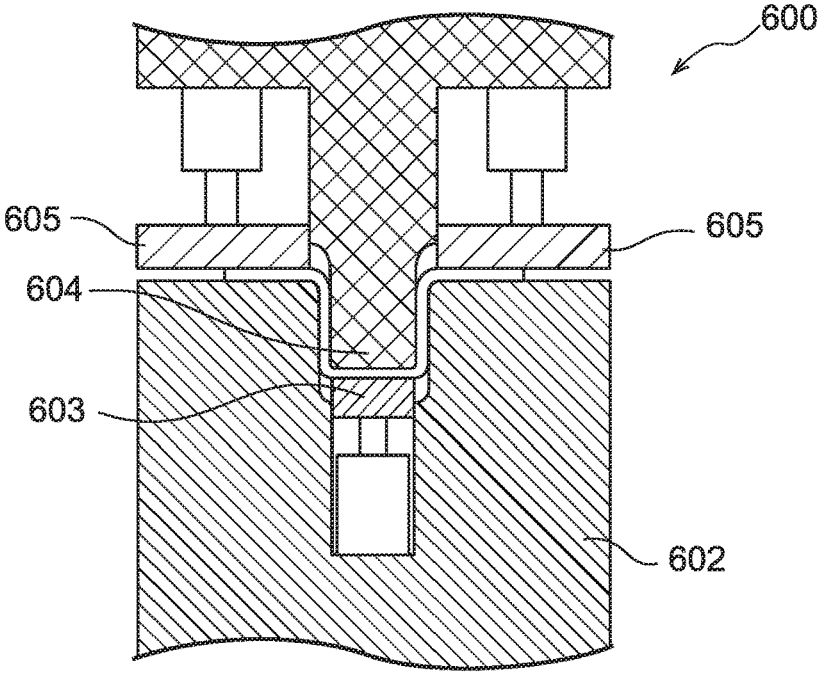
FIG. 8C is a cross-section illustrating a stage at which the punch has been pushed in from the stage illustrated in FIG. 8B.
Figure 8D:
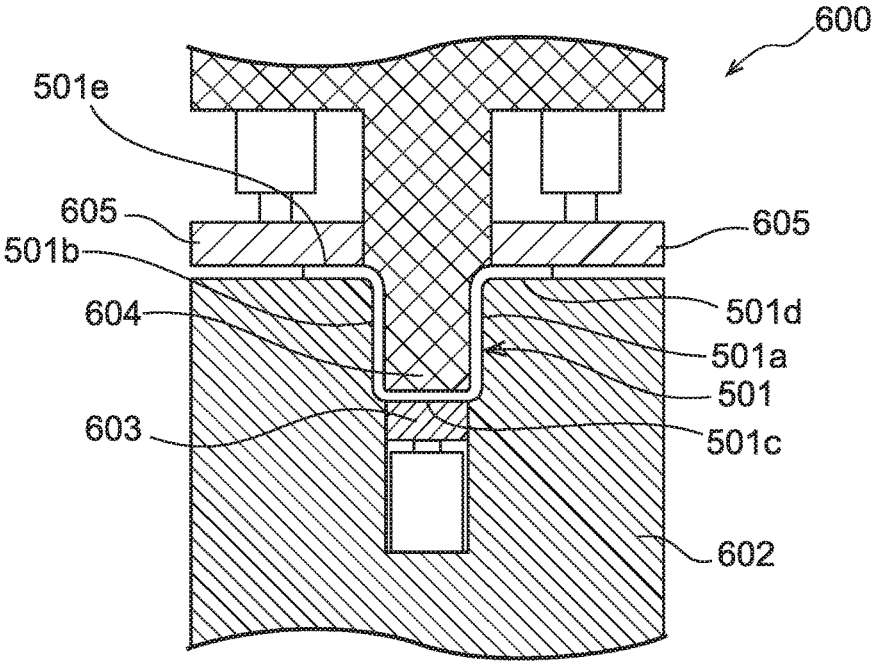
FIG. 8D is a cross-section illustrating a state in which the punch has been pushed in further from the stage illustrated in FIG. 8C, such that the punch has been fully pushed in with respect to the die.

FIG. 7 illustrates a hat-shaped cross-section component manufacturing apparatus 600 according to another exemplary embodiment for manufacturing the curving component 501. FIG. 8A is a cross-section illustrating the manufacturing apparatus illustrated in FIG. 7 at a stage at the start of processing. FIG. 8B is a cross-section illustrating a stage at which the metal stock sheet 601 is gripped and restrained between a die 602 and pad 603, and a holder 605 and punch 604 of the manufacturing apparatus illustrated in FIG. 7. FIG. 8C is a cross-section illustrating a stage at which the punch 604 has been pushed in from the stage illustrated in FIG. 8B. FIG. 8D is a cross-section illustrating a state in which the punch 604 has been pushed in further from the stage illustrated in FIG. 8C, such that the punch 604 has been fully pushed in with respect to the die 602.

In contrast to the hat-shaped cross-section component manufacturing apparatus 500 illustrated in FIG. 5 and FIG. 6A to FIG. 6D, in the hat-shaped cross-section component manufacturing apparatus 600 the blank holder 605 and the punch 604 are provided at an upper side of the die 602 and the pad 603. In the hat-shaped cross-section component manufacturing apparatus 600, the curving component 501 is formed by moving (lowering) the pad 603 and the punch 604 in a state in which the die 602 is fixed, and the blank holder 605 presses the metal stock sheet 601 against the die 602 without moving. Note that in both the hat-shaped cross-section component manufacturing apparatus 600 and the hat-shaped cross-section component manufacturing apparatus 500, the relative movement within the mold is the same, and the metal stock sheet 601 can be formed into the curving component 501 by using whichever of the hat-shaped cross-section component manufacturing apparatuses 500, 600.

Next, explanation follows regarding a removal process of the curving component 501 from the hat-shaped cross-section component manufacturing apparatus 500 (mold) after pressing the metal stock sheet 601, namely after forming the curving component 501.

Figure 9A:
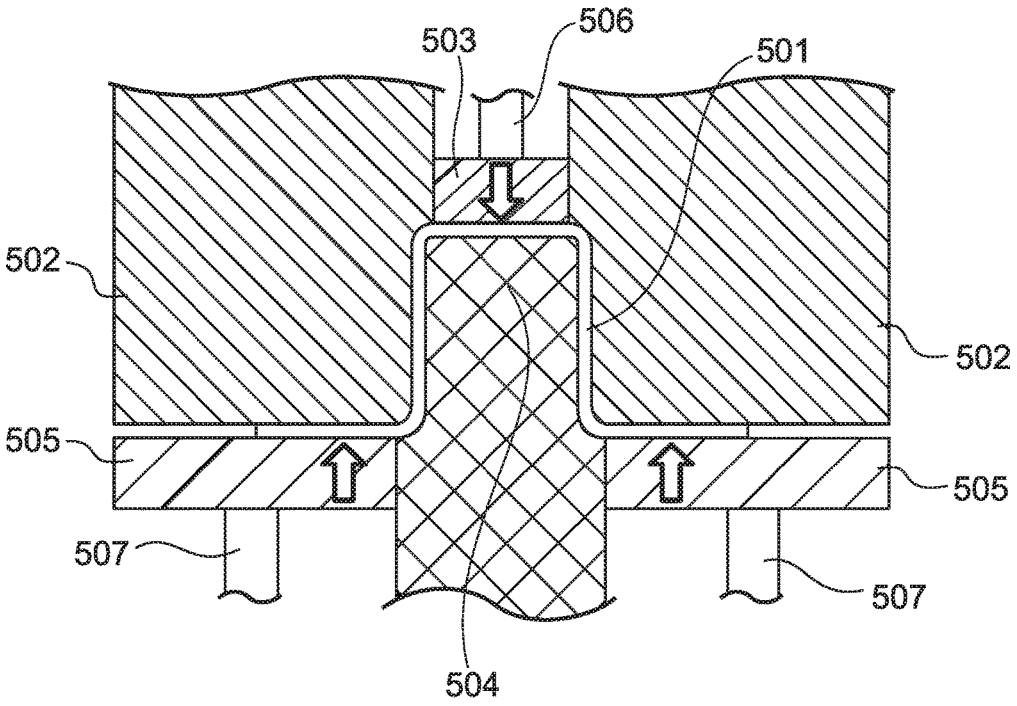
FIG. 9A is a cross-section illustrating a mold to explain a defect that occurs when removing a curving component from the mold after a punch has been fully pushed into a die and a metal stock sheet has been formed into the curving component.
Figure 9B:
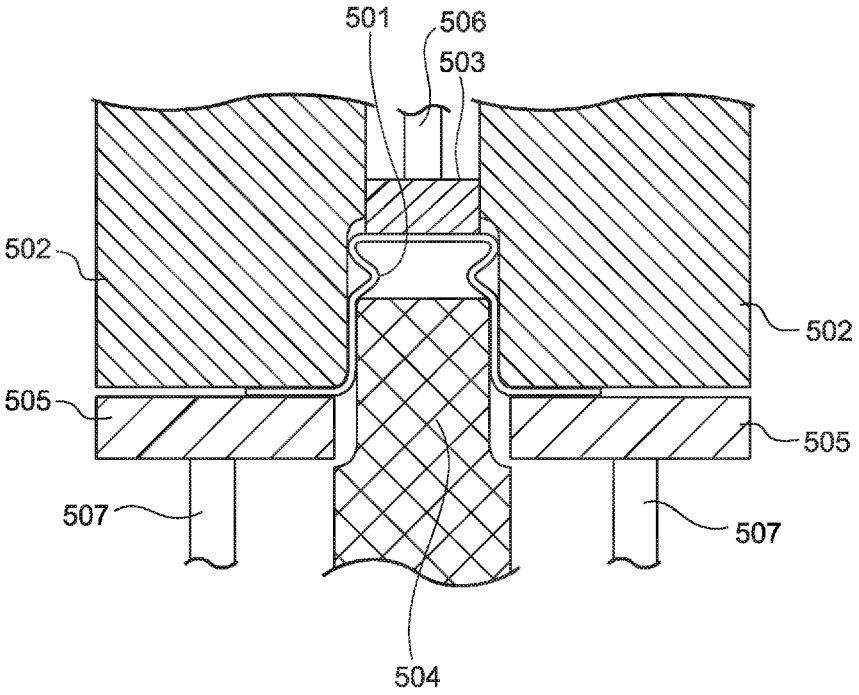
FIG. 9B is a cross-section illustrating the mold at a stage in which the punch is being retracted from the die from the state illustrated in FIG. 9A.
Figure 9C:
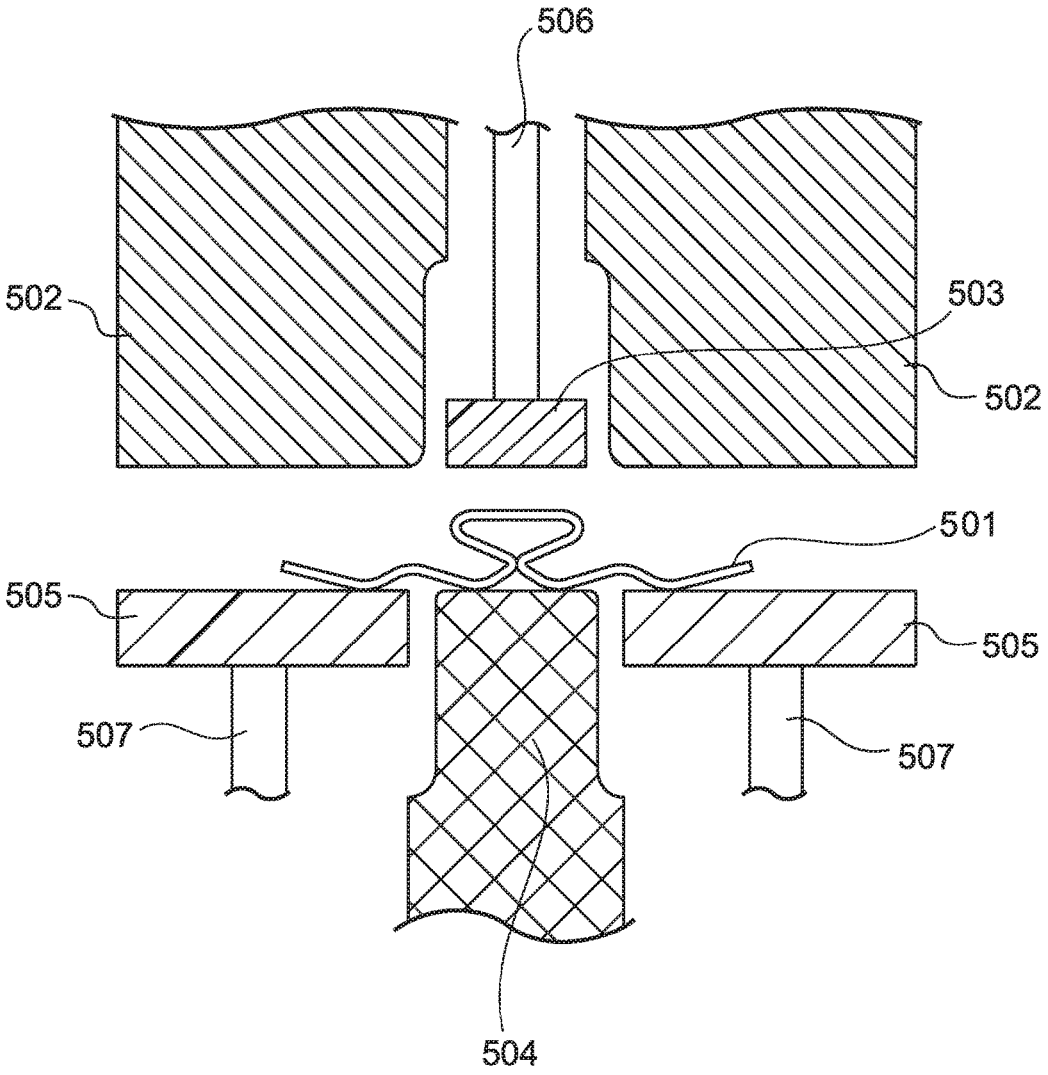
FIG. 9C is a cross-section illustrating the mold at a stage in which the punch has been fully retracted from the die from the state illustrated in FIG. 9B.

As illustrated in FIG. 9A to FIG. 9C, when the curving component 501 is demolded from the hat-shaped cross-section component manufacturing apparatus 500 (mold), it is necessary to move the die 502, upward from the state in FIG. 6D and away from the punch, 504 to create a gap within the mold. When this is performed, as illustrated in FIG. 9B and FIG. 9C, while the pad 503 and the blank holder 505 are being pressed by the respective pad press device 506 and the blank holder press devices 507, the curving component 501 bears pressing force directed in mutually opposing directions from the pad 503 and the blank holder 505 during demolding, deforming and crushing the curving component 501 by the pressing forces directed in opposite directions, as illustrated in FIG. 9C.

Figure 10A:
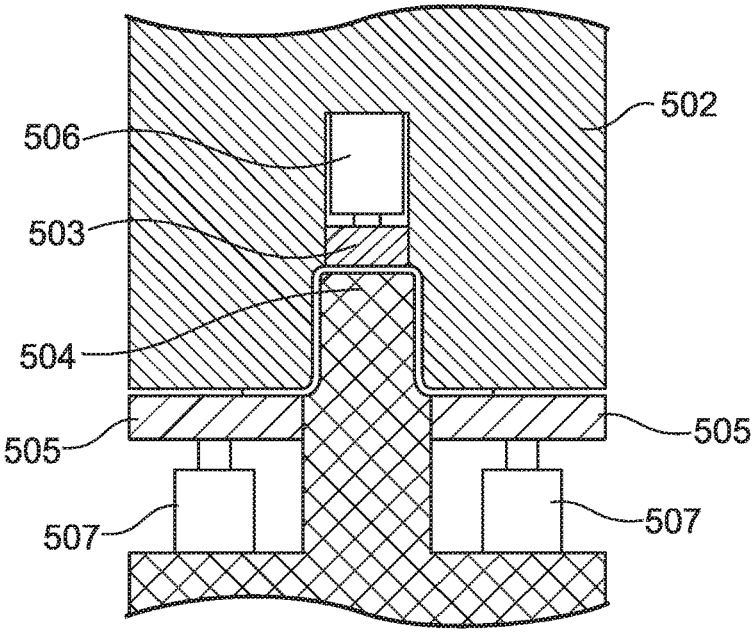
FIG. 10A is a cross-section illustrating a mold, in a state in which a punch has been fully pushed into a die.
Figure 10B:
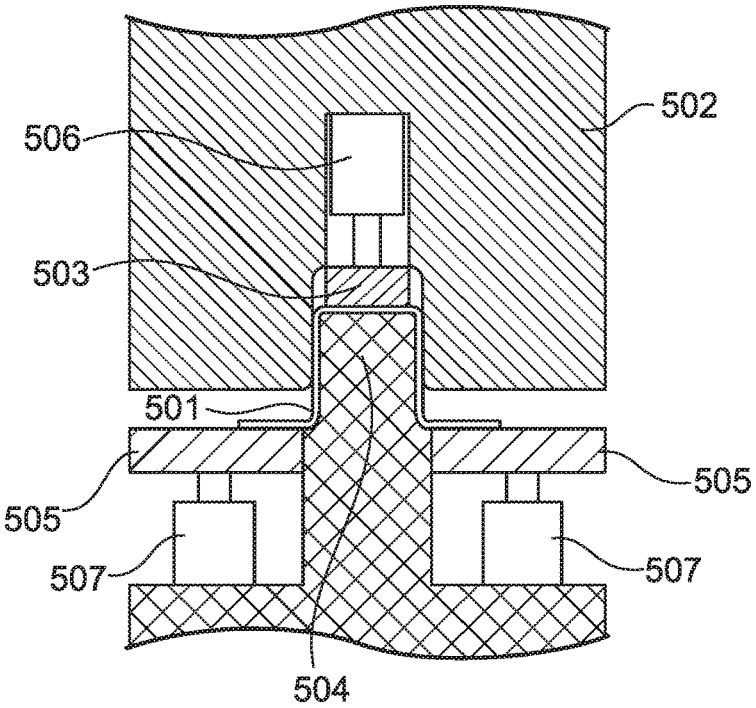
FIG. 10B is a cross-section illustrating the mold at a stage in which the punch is being retracted from the die from the state illustrated in FIG. 10A.
Figure 10C:
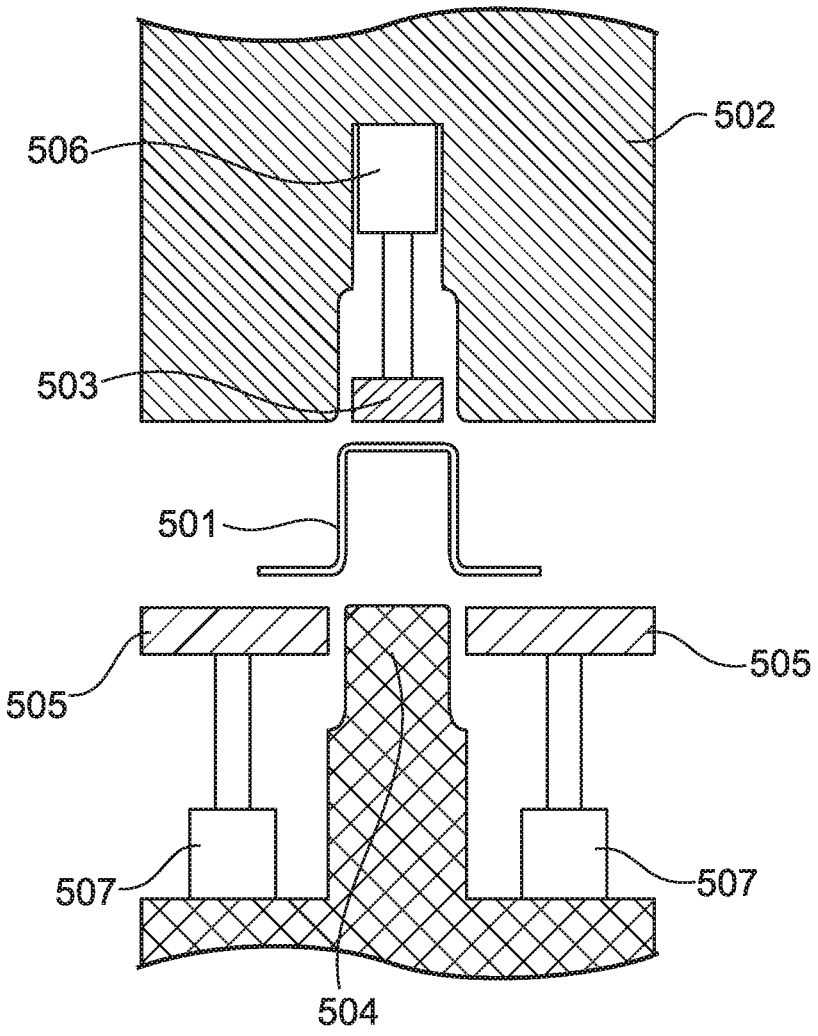
FIG. 10C is a cross-section illustrating the mold at a stage in which the punch has been fully retracted from the die from the state illustrated in FIG. 10B.

Accordingly, as illustrated in FIG. 10A to FIG. 10C, after the metal stock sheet 601 has been formed into the curving component 501, configuration is made such that the die 502 and the pad press device 506 are separated from the blank holder 505 in a state in which the blank holder 505 does not move relative to the punch 504, and the blank holder 505 does not press the formed curving component against the die 502. Accordingly, although the pad 503 presses the curving component until the pad press device 506 has extended to the end of its stroke, after the pad press device 506 has moved a specific distance or greater and the pad press device 506 has fully extended to the end of its stroke, the pad 503 is separated from the punch 504. The curving component 501 therefore does not bear pressing from the pad 503 and the blank holder 505 at the same time, and the die 502 and the pad 503 can be separated from the blank holder 505 and the punch 504, thereby enabling the curving component 501 to be removed from the mold without being deformed.

Figure 11A:
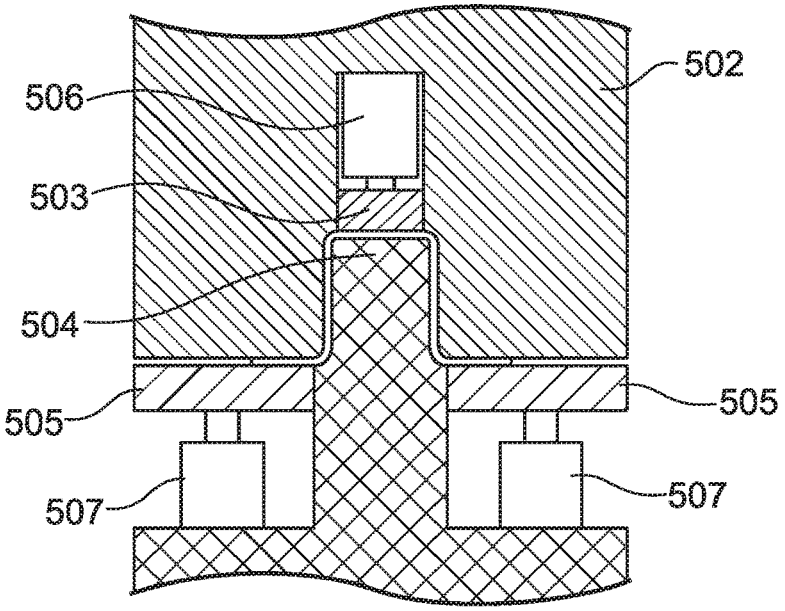
FIG. 11A is a cross-section illustrating a mold, in a state in which a punch has been fully pushed into a die.
Figure 11B:
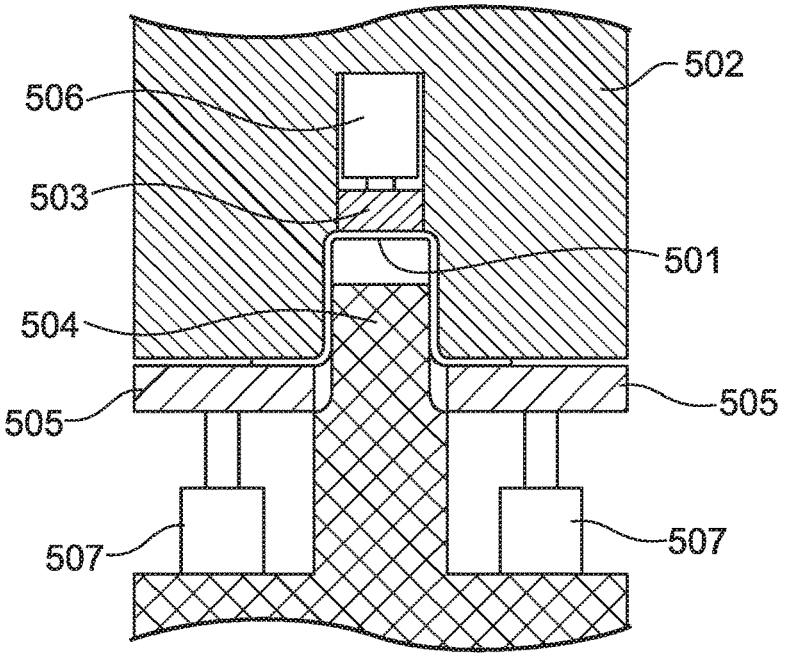
FIG. 11B is a cross-section illustrating the mold at a stage in which the punch is being retracted from the die from the state illustrated in FIG. 11A.
Figure 11C:
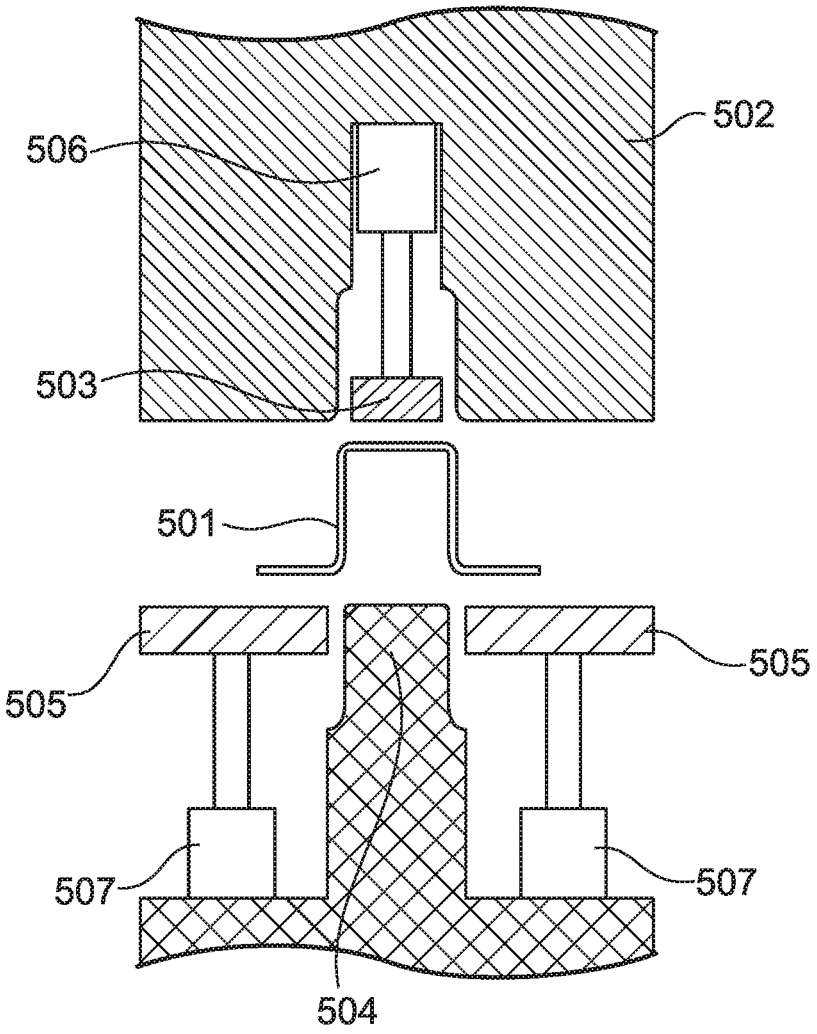
FIG. 11C is a cross-section illustrating the mold at a stage in which the punch has been fully retracted from the die from the state illustrated in FIG. 11B.

As another exemplary embodiment, as illustrated in FIG. 11A to FIG. 11C, after forming the metal stock sheet into the curving component 501, the pad 503 is not moved relative to the die 502, and the pad 503 does not press the formed curving component 501 against the punch 504. In this state, when the pad 503 and the die 502 are separated from the blank holder 505 and the punch 504, the blank holder 505 presses the curving component until the blank holder press devices 507 extend to the end of their stroke. The blank holder 505 is then separated from the die 502 after the die 502 has moved a specific distance or greater and the blank holder press devices 507 have fully extended to the end of their stroke. This thereby enables the die 502 and pad 503, and the blank holder 505 and punch 504, to be separated without the curving component 501 bearing pressure from the pad 503 and the blank holder 505 at the same time, thereby enabling the curving component 501 to be removed from the mold.

Yet another exemplary embodiment is one in which, although not illustrated in the drawings, after forming the metal stock sheet into the curving component 501, the pad 503 does not move relative to the blank holder 505, and the pad 503 does not press the formed curving component against the punch 504. In this state, when the pad 503, die 502, and blank holder 505 are separated from the punch 504, the blank holder 505 presses the curving component 501 until the blank holder press devices 507 have extended to the end of their strokes. After the die 502 moves a specific distance or greater and the blank holder press devices 507 have fully extended to the end of their stroke, the blank holder 505 is then separated from the die 502. This thereby enables the die 502 and pad 503 to be separated, from the blank holder 505 and punch 504, without the curving component 501 bearing pressure from the pad 503 and the blank holder 505 at the same time, thereby enabling the curving component 501 to be removed from the mold.

Accordingly, in order to prevent damage to the curving component 501 during demolding, the hat-shaped cross-section component manufacturing apparatus 500 may be provided with a pressure limiting device capable of preventing the curving component 501 from bearing pressure from the pad 503 and the blank holder 505 at the same time.

Explanation follows regarding a specific configuration of a pressure limiting device provided to the hat-shaped cross-section component manufacturing apparatus 500.

Pressure Limiting Device Configuration

Figure 12A:
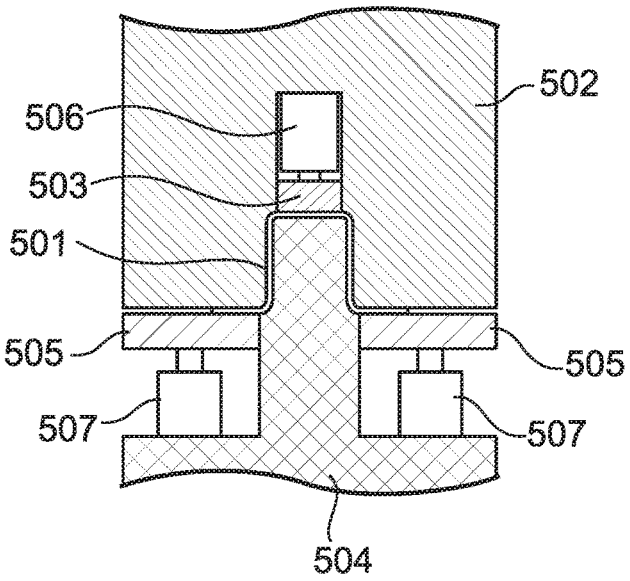
FIG. 12A is an explanatory diagram illustrating a mold including a pressure limiting device for removing a curving component from the mold without causing deformation, in a state when forming has been completed.
Figure 12B:
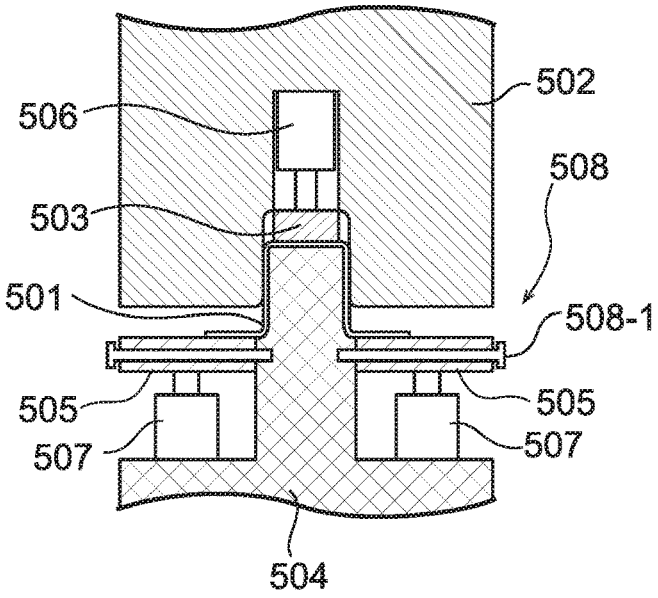
FIG. 12B is an explanatory diagram illustrating the mold in a state in which the pressure limiting device is functioning.
Figure 12C:
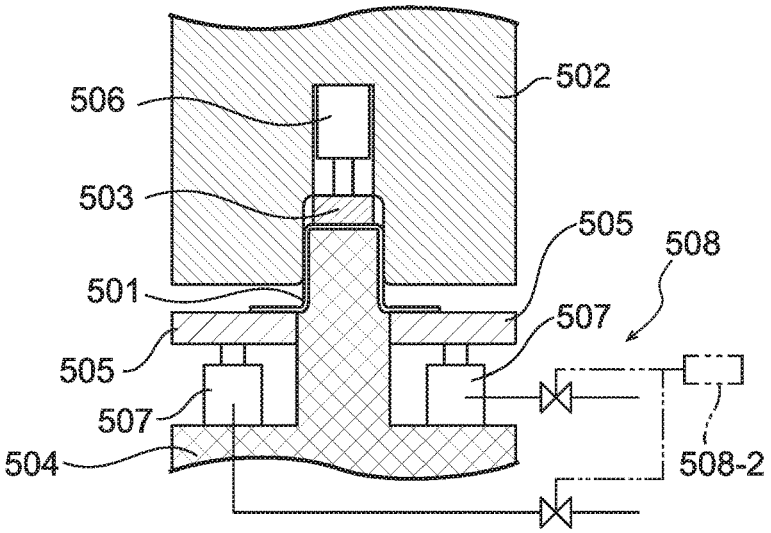
FIG. 12C is an explanatory diagram illustrating the mold in a state in which the pressure limiting device is functioning.
Figure 12D:
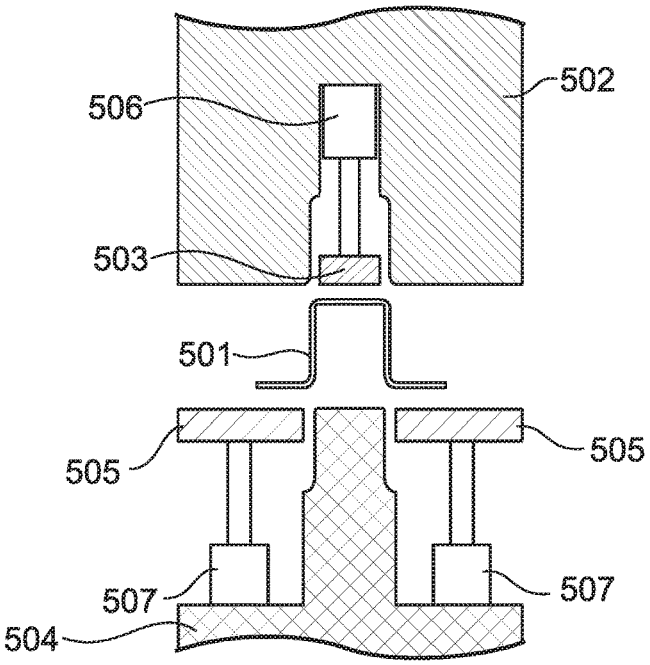
FIG. 12D is an explanatory diagram illustrating the mold including the pressure limiting device, in a state when demolding has been completed.

A pressure limiting device 508 illustrated in FIG. 12A to FIG. 12D is configured including a holder side limiting section 508-1, illustrated in FIG. 12B, that mounts to the blank holder 505 and mechanically limits movement of the blank holder 505 in a mold closing direction (the up-down direction), or by a controller 508-2, illustrated in FIG. 12C, that controls at least one out of the stroke and pressing force of the blank holder press devices 507. During demolding, movement of the blank holder 505 toward the die 502 side is controlled by the holder side limiting section 508-1, or at least one out of the stroke or pressing force of the blank holder press devices 507, is controlled by the controller 508-2. The curving component 501 is accordingly prevented from bearing pressure from both the pad 503 and the blank holder 505 at the same time. This thereby enables the curving component 501 to be removed from the mold in a state in which damage to the curving component 501 is prevented.

Note that preventing the curving component 501 from bearing pressure from the pad 503 and the blank holder 505 at the same time refers to pressure exceeding permissible deformation limits for an article.

The holder side limiting section 508-1 is, for example, configured by bolts or pins serving as fixing tools that fix the blank holder 505 to the punch 504 or the like. Such bolts or pins may be manually operated to fix the blank holder 505 to the punch 504 or the like, or the bolts or pins may be operated by an actuator to fix the blank holder 505 to the punch 504. The controller 508-2, for example, controls a regulator valve that regulates the gas pressure or the hydraulic pressure of the blank holder press devices 507, or controls the electric drive device.

Figure 13A:
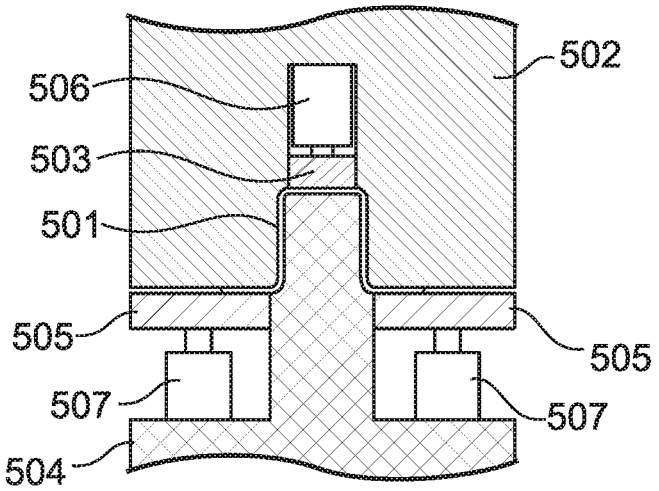
FIG. 13A is an explanatory diagram illustrating a mold including a pressure limiting device for removing a curving component from the mold without causing deformation, in a state when forming has been completed.
Figure 13B:
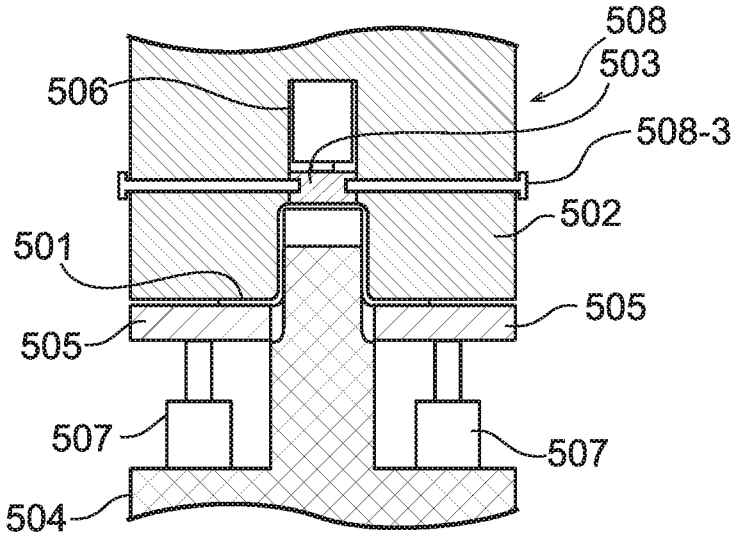
FIG. 13B is an explanatory diagram illustrating the mold in a state in which the pressure limiting device is functioning.
Figure 13C:
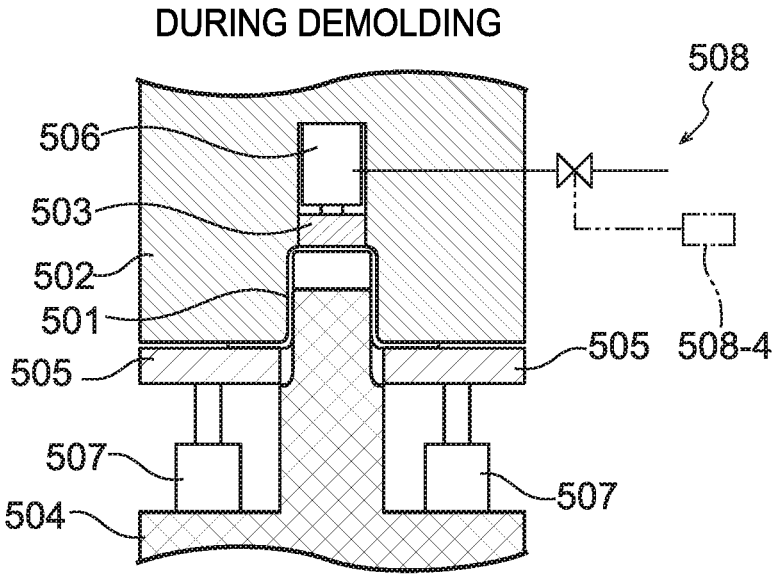
FIG. 13C is an explanatory diagram illustrating the mold in a state in which the pressure limiting device is functioning.
Figure 13D:
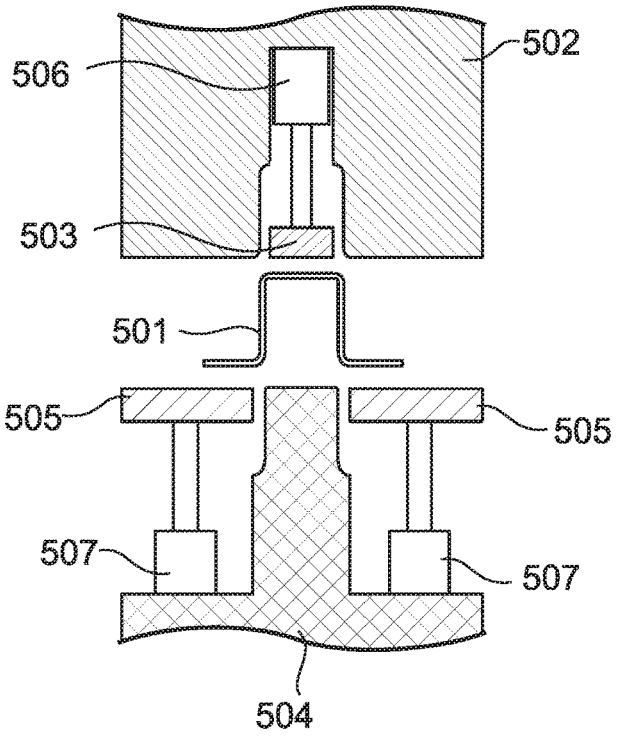
FIG. 13D is an explanatory diagram illustrating the mold including the pressure limiting device, in a state when demolding has been completed.

The pressure limiting device 508 illustrated in FIG. 13A to FIG. 13D is configured including a pad side limiting section 508-3, illustrated in FIG. 13B, that mounts to the pad 503 and mechanically limits movement of the pad 503 in the mold closing direction (the up-down direction), or a controller 508-4, illustrated in FIG. 13C, that controls at least one out of the stroke or the pressing force of the pad press device 506. Movement of the pad 503 toward the punch 504 side during demolding is limited by the pad side limiting section 508-3, or at least one out of the stroke and pressing force of the pad press device 506 is controlled by the controller 508-4. The curving component 501 is accordingly prevented from bearing pressure from the pad 503 and the blank holder 505 at the same time. This thereby enables the curving component 501 to be removed from the mold in a state in which damage to the curving component 501 is prevented. The pad side limiting section 508-3 is, for example, bolts or pins serving as fixing tools that fix the pad 503 to the die 502 or the like. Such bolts or pins may be manually operated to fix the pad 503 to the die 502 or the like, or the bolts or pins may be operated by an actuator to fix the pad 503 to the die 502. The controller 508-4, for example, controls a pressure regulator valve that adjusts the gas pressure or the hydraulic pressure, or controls the electric drive device, of the pad press device 506.

Figure 13E:
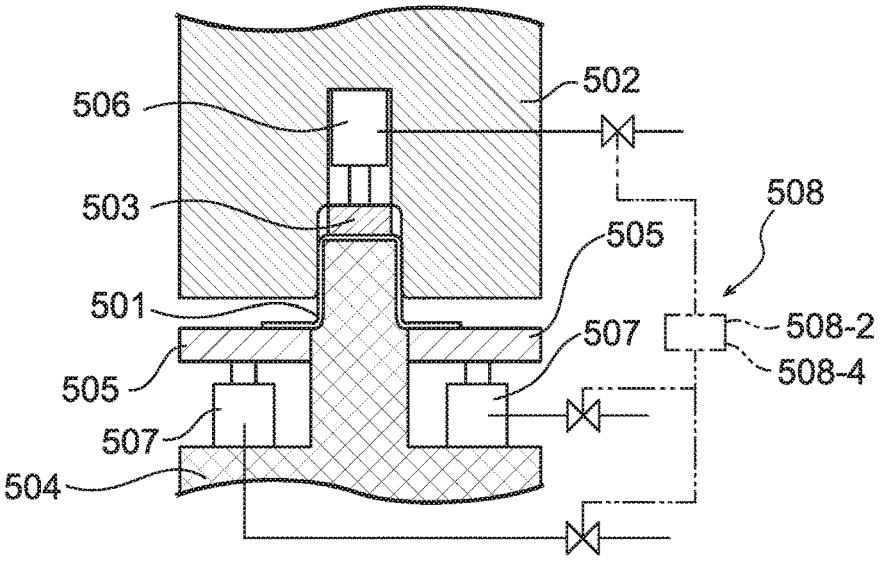
FIG. 13E is an explanatory diagram, corresponding to FIG. 12C and FIG. 13C, illustrating the mold in a state in which the pressure limiting device is functioning.
Figure 14A:
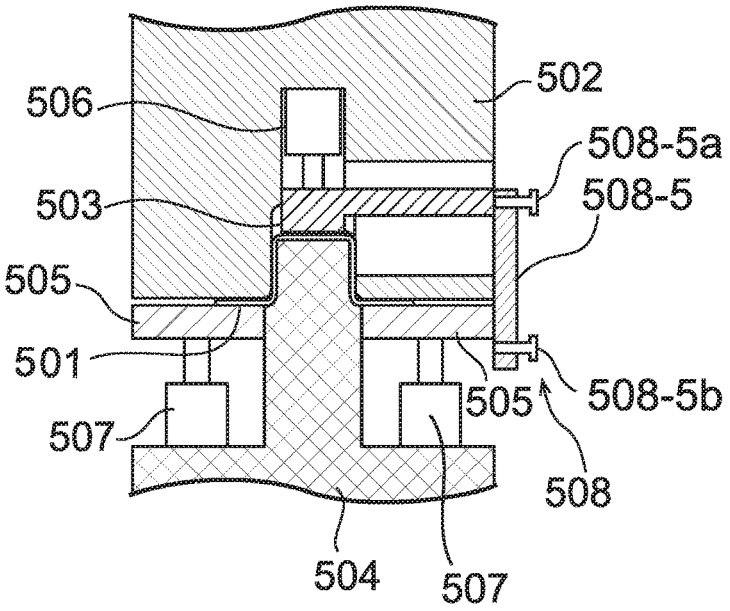
FIG. 14A is an explanatory diagram illustrating a mold including a pressure limiting device for removing a curving component from the mold without causing deformation, in a state when forming has been completed.
Figure 14B:
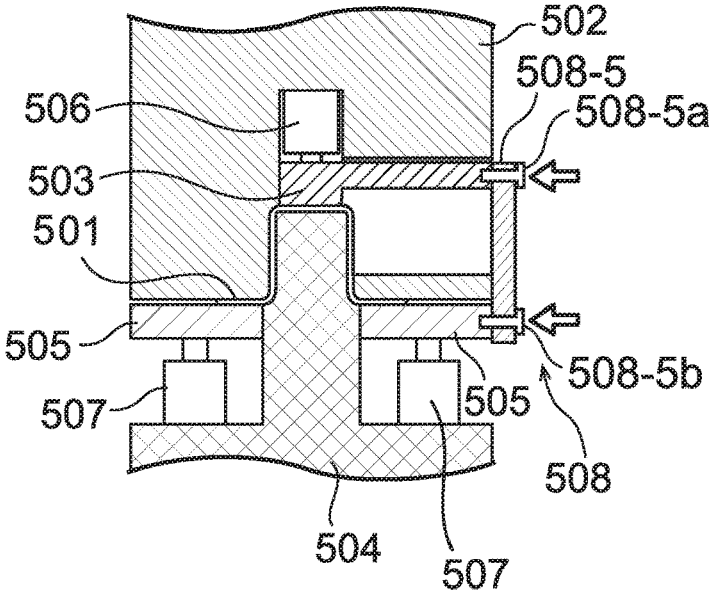
FIG. 14B is an explanatory diagram illustrating the mold in a state in which the pressure limiting device is functioning.
Figure 14C:
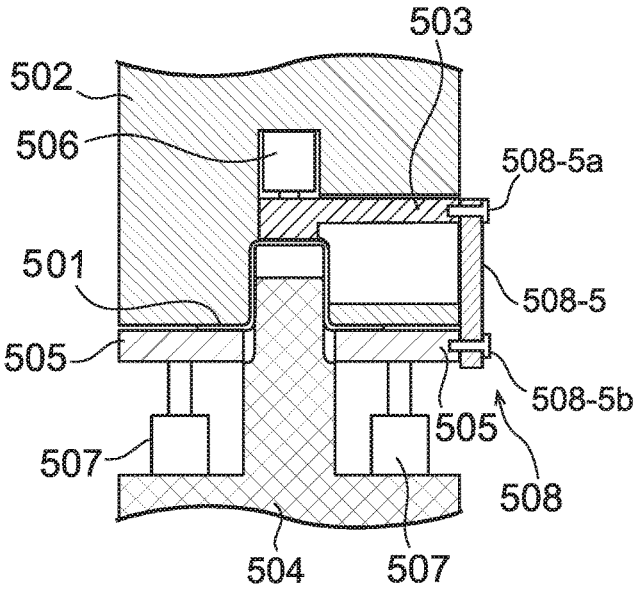
FIG. 14C is an explanatory diagram illustrating the mold in the process of raising a die in a state in which the pressure limiting device is functioning.
Figure 14D:
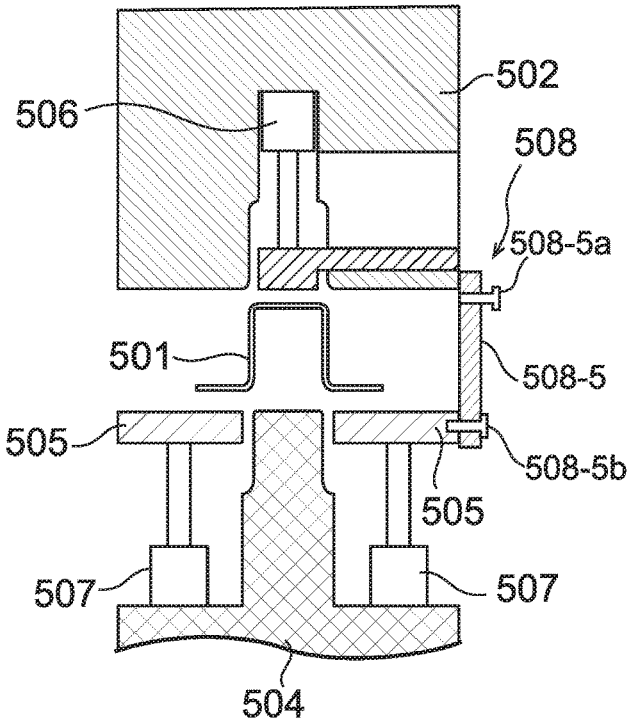
FIG. 14D is an explanatory diagram illustrating the mold including the pressure limiting device, in a state when demolding has been completed.

As illustrated in FIG. 13E, the curving component 501 may be prevented from bearing pressure from the pad 503 and the blank holder 505 at the same time by both controlling at least one out of the stroke or the pressing force of the blank holder press devices 507, and controlling at least one out of the stroke or the pressing force of the pad press device 506. In order to perform the above control, sensors may be provided to detect the stroke, hydraulic pressure, and the like of the blank holder press devices 507 and the pad press device 506. Moreover, prior to opening the die 502 and the punch 504 after forming, the curving component 501 may be prevented from bearing pressure from the pad 503 and the blank holder 505 at the same time by moving the blank holder 505 or the pad 503 by further than the mold opening stroke of the die 502 and the punch 504.

The pressure limiting device 508 illustrated in FIG. 14A to FIG. 14D is configured including a spacer block 508-5, serving as a coupling portion that couples the punch 504 and blank holder 505 together during demolding so as to fix the positional relationship between the punch 504 and the blank holder 505, and lock pins 508-5*a*, 508-5*b* that are inserted into the spacer block 508-5. The spacer block 508-5 is disposed at a position (original position) that does not impede formation of the curving component 501 when forming is in progress. After forming of the curving component 501 has been completed, the lock pins 508-5*a*, 508-5*b* inserted into the spacer block 508-5 are moved, for example, mechanically, pneumatically, hydraulically, or electrically, and the lock pins 508-5*a*, 508-5*b* are inserted into respective insertion holes provided to the pad 503 and the blank holder 505. This thereby prevents the curving component 501 from bearing pressure from the pad 503 and the blank holder 505 at the same time during demolding, due to pushing up the pad 503 together with raising of the blank holder 505. This thereby enables the curving component 501 to be removed from the mold in a state in which damage to the curving component 501 is prevented. After demolding completion, the lock pins 508-5*a*, 508-5*b* are pulled out from the insertion holes, not illustrated in the drawings, respectively provided to the pad 503 and the blank holder 505, and the spacer block 508-5 returns to its initial original position. In the present exemplary embodiment, part of the pad 503 extends out toward the side in a side direction of the die 502. The lock pin 508-5*a* is inserted into this extending portion. The extending portion is, moreover, disposed at the outside of the mold. Note that the portion extending out from the pad 503 may be coupled and integrated together with the spacer block 508-5, and only the lock pin 508-5*b* inserted into an insertion hole, not illustrated in the drawings, provided to the blank holder 505. Alternatively, the blank holder 505 and the spacer block 508-5 may be coupled and integrated together, and only the lock pin 508-5*a* inserted into an insertion hole, not illustrated in the drawings, provided to the portion extending out from the pad 503.

Operation and Advantageous Effects of Present Exemplary Embodiment, Suitable Values Etc. For Various Parameters Next, explanation follows regarding operation and advantageous effects of the present exemplary embodiment, and suitable values for various parameters, and the like.

As illustrated in FIG. 12 to FIG. 14, in the present exemplary embodiment, the hat-shaped cross-section component manufacturing apparatus 500 is provided with the pressure limiting device 508 described above. During demolding, the curving component 501 can be removed from the mold (the blank holder 505, the die 502, the punch 504, and the pad 503) in a state in which the formed curving component 501 is prevented by the pressure limiting device 508 from being pressed by the pad 503 and the blank holder 505 at the same time.

In the present exemplary embodiment, during formation of the vertical walls 501*a*, 501*b* of the curving component 501 by the hat-shaped cross-section component manufacturing apparatus 500 illustrated in FIG. 5 to FIG. 6D, the portion of the metal stock sheet 601 that will form the top plate 501*c* is pressed and gripped by the pad 503 and the punch 504. Provided that the pressing force is sufficient, the portion of the metal stock sheet 601 that will form the top plate 501*c* cannot be deformed in its thickness direction during the forming process, enabling the occurrence of creases at this portion to be suppressed. Moreover, the portions of the metal stock sheet 601 that will form the outward extending flanges 501*d*, 501*e* are also pressed and gripped by the blank holder 505 and the die 502, such that provided that the pressing force is sufficient, the portions of the metal stock sheet 601 that will form the outward extending flanges 501*d*, 501*e* cannot be deformed in the thickness direction, enabling the occurrence of creases at these portions to be suppressed.

However, if the above pressing forces are insufficient, deformation of the metal stock sheet 601 in the thickness direction cannot be prevented, and creases will occur at the portion of the metal stock sheet 601 that will form the top plate 501*c* and at the portions of the metal stock sheet 601 that will form the outward extending flanges 501*d*, 501*e*. The sheet thickness employed in structural members configuring automotive vehicle body framework (such as front side members) is generally from 0.8 mm to 3.2 mm. When a steel sheet with tensile strength of from 200 MPa to 1600 MPa is formed using the hat-shaped cross-section component manufacturing apparatus 500 illustrated in FIG. 5 to FIG. 6D, the above pressing forces are preferably 0.1 MPa or greater.

Figure 15A:
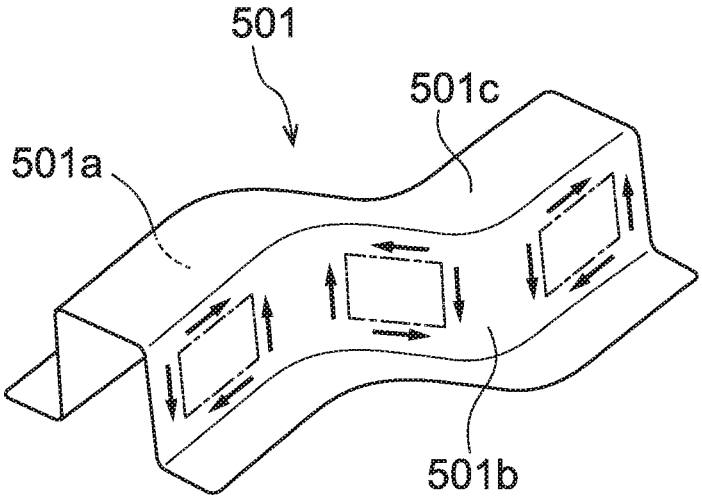
FIG. 15A is a perspective view of a curving component, schematically illustrating stress occurring in vertical walls.
Figure 15B:
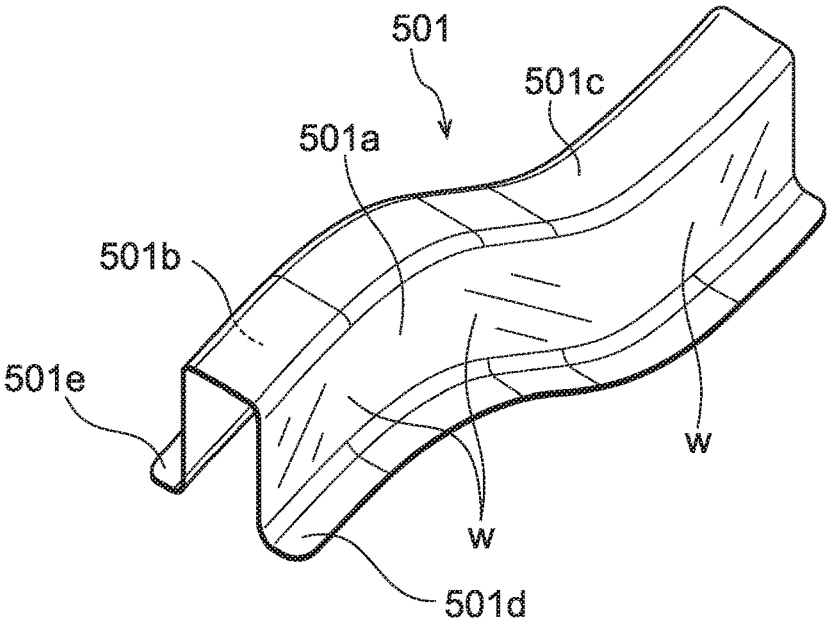
FIG. 15B is a perspective view of the curving component, illustrating shear creasing occurring in the vertical walls.
Figure 15C:
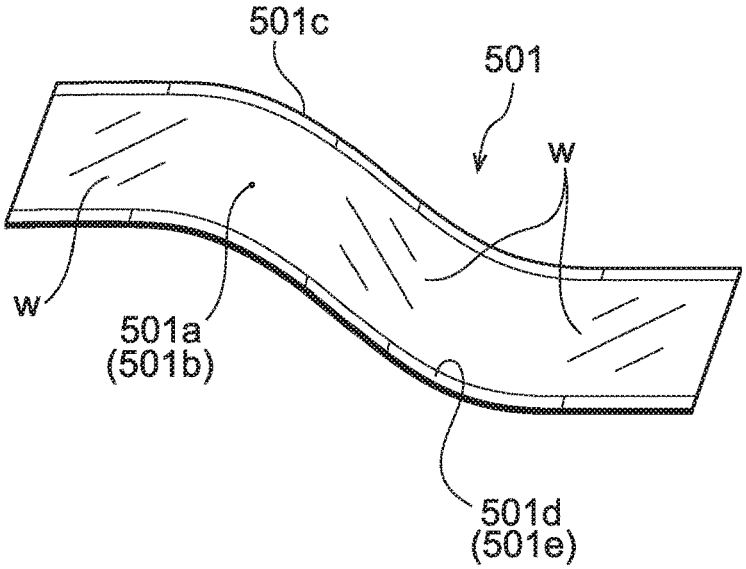
FIG. 15C is a side view of the curving component, illustrating shear creasing occurring in the vertical walls.
Figure 16A:
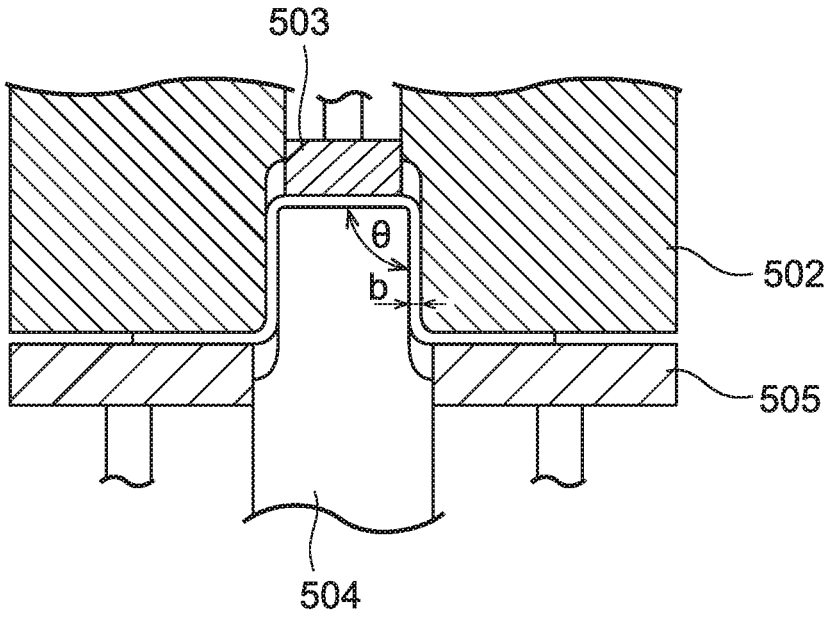
FIG. 16A is a cross-section a hat-shaped cross-section component manufacturing apparatus to explain the dimensions and the like of respective portions in order to prevent the occurrence of shear creasing.
Figure 16B:
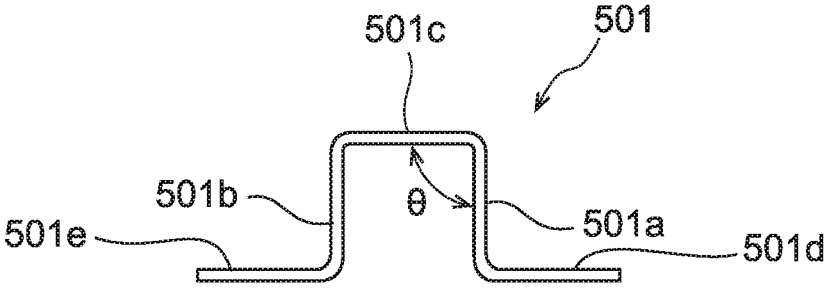
FIG. 16B is a cross-section of a curving component to explain the dimensions and the like of respective portions in order to prevent the occurrence of shear creasing.
Figure 16C:
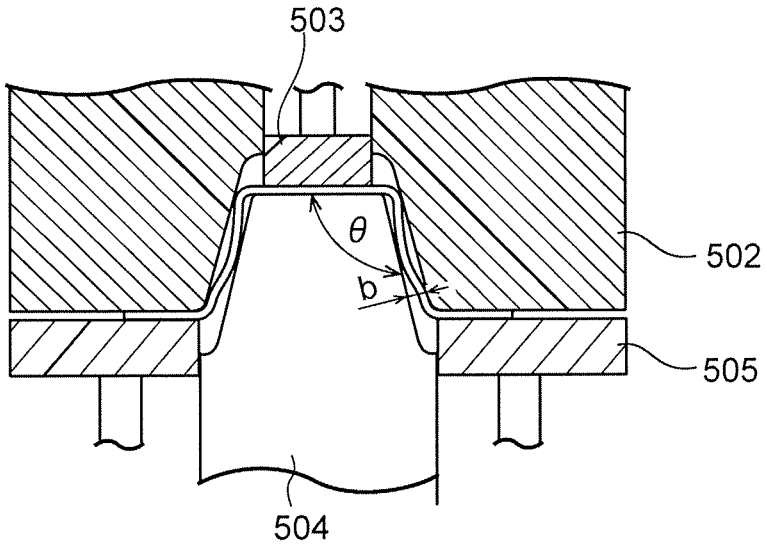
FIG. 16C is a cross-section of a hat-shaped cross-section component manufacturing apparatus to explain the dimensions and the like of respective portions in order to prevent the occurrence of shear creasing.
Figure 16D:
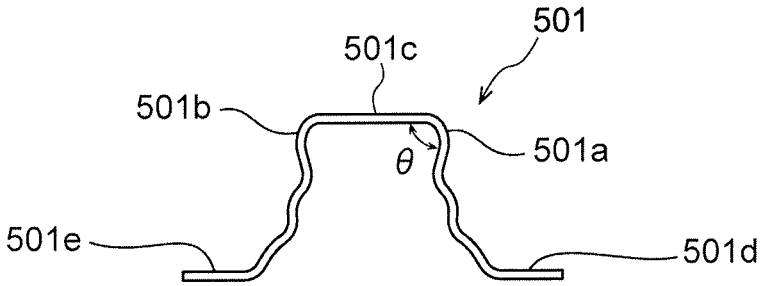
FIG. 16D is cross-section of a curving component to explain the dimensions and the like of respective portions in order to prevent the occurrence of shear creasing.

FIG. 15A illustrates stress arising in the vertical walls 501*a*, 501*b* of the curving component 501. FIG. 15B and FIG. 15C illustrate shear creasing arising in the vertical walls 501*a*, 501*b* of the curving component 501.

In FIG. 15A, it can be seen that deformation of the portions of the metal stock sheet 601 that will form the vertical walls 501*a*, 501*b* from before to after forming the vertical walls 501*a*, 501*b* of the curving component 501 is mainly shear deformation. Forming the vertical walls 501*a*, 501*b* of the curving component 501 accompanied by deformation that is mainly shear deformation suppresses a reduction in the sheet thickness of the vertical walls 501*a*, 501*b* compared to the sheet thickness of the metal stock sheet 601. This thereby enables the occurrence of creasing and cracking in the vertical walls 501*a*, 501*b* to be suppressed.

During formation of the vertical walls 501*a*, 501*b*, the portions of the metal stock sheet 601 that will form the vertical walls 501*a*, 501*b* undergo compression deformation in the minimum principal strain direction of the shear deformation. Accordingly, as illustrated in FIG. 15B and FIG. 15C, shear creasing W occurs in the vertical walls 501*a*, 501*b* of the curving component 501 if the clearance between the die 602 and the punch 604 becomes large. In order to suppress such shear creasing W, it is effective to reduce the clearance between the die 602 and the punch 604 such that the clearance is brought close to the sheet thickness of the metal stock sheet 601 during formation of the vertical walls 501*a*, 501*b*.

As illustrated in FIG. 16A to FIG. 16D, it is necessary for an internal angle θ formed between the respective vertical walls 501*a*, 501*b* and the top plate 501*c* to be 90° or greater so as not to have a negative mold angle during forming. However, since the clearance during initial forming increases if too far over 90°, an angle close to 90° that is 90° or greater is advantageous. When a steel sheet with a sheet thickness of from 0.8 mm to 3.2 mm, and tensile strength of from 200 MPa to 1600 MPa, that is generally employed in structural members configuring automotive vehicle body framework, is used to form a component in which the height of the vertical walls 501*a*, 501*b* is 200 mm or less, the internal angle formed between the top plate 501*c* and the vertical walls 501*a*, 501*b* is preferably from 90° to 92°, and a clearance b between the die 502 and the punch 504 at the portions forming the vertical walls 501*a*, 501*b* at the point when forming of the vertical walls 501*a*, 501*b* is completed is preferably from 100% to 120% of the sheet thickness of the metal stock sheet 601.

Next, explanation follows regarding results of investigation into the occurrence of creasing in the curving component 501, using parameters of (1) the angle formed between the vertical walls 501*a*, 501*b* and the top plate 501*c*, (2) mold clearance (varying the sheet thickness t with respect to the fixed clearance b), (3) the pressure applied to the pad 503 (pad pressure), (4) the pressure applied to the blank holder 505 (holder pressure), and (5) the tensile strength of the material.

Figure 17A:
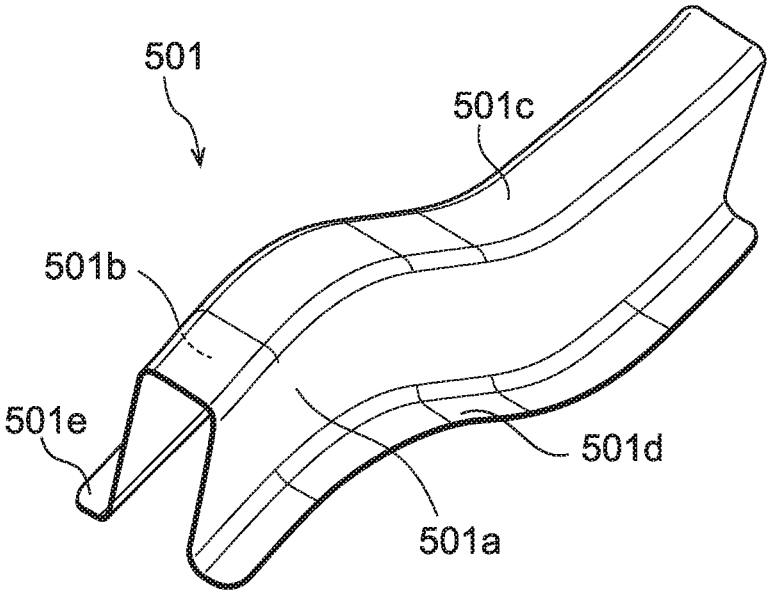
FIG. 17A is a perspective view of a curving component manufactured by the hat-shaped cross-section component manufacturing apparatus illustrated in FIG. 5.
Figure 17B:
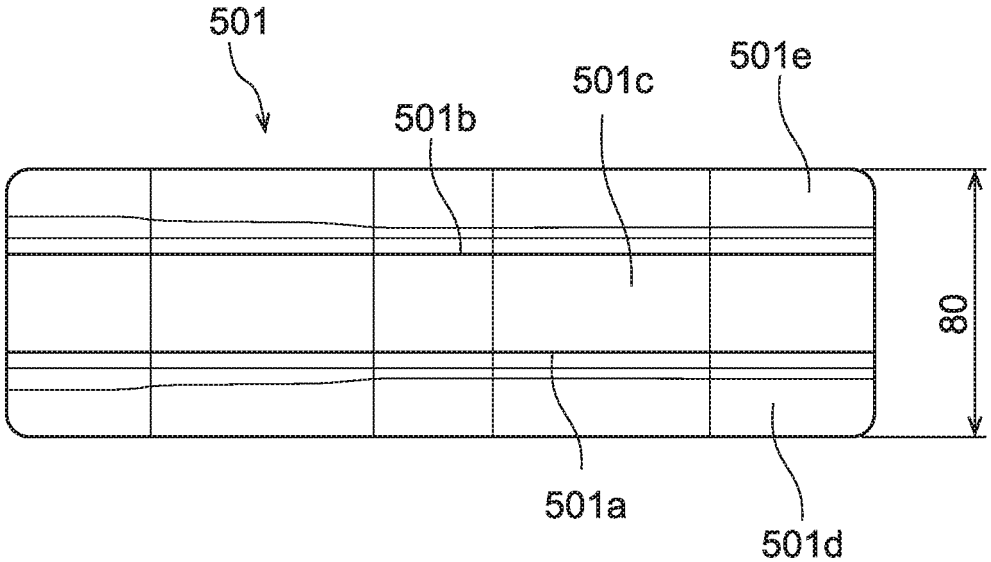
FIG. 17B is a plan view of the curving component illustrated in FIG. 17A, as viewed from above.
Figure 17C:
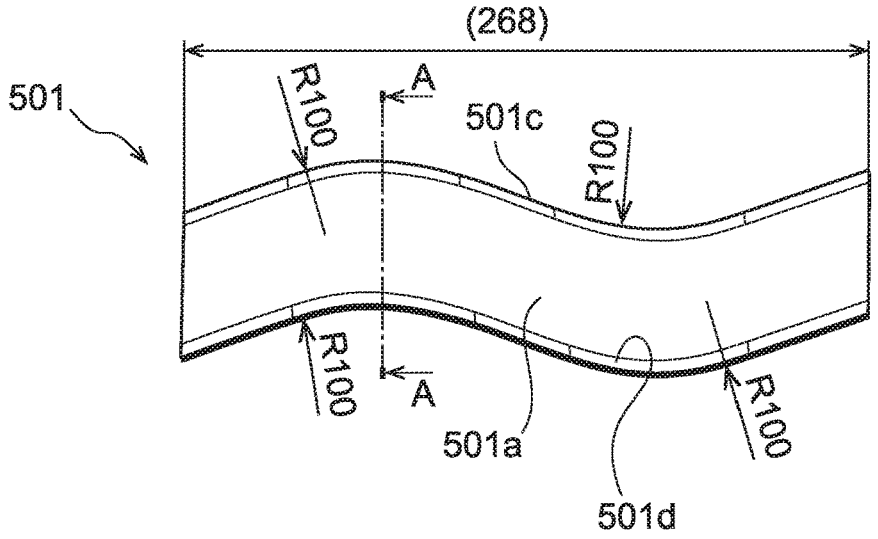
FIG. 17C is a side view of the curving component illustrated in FIG. 17A.
Figure 17D:
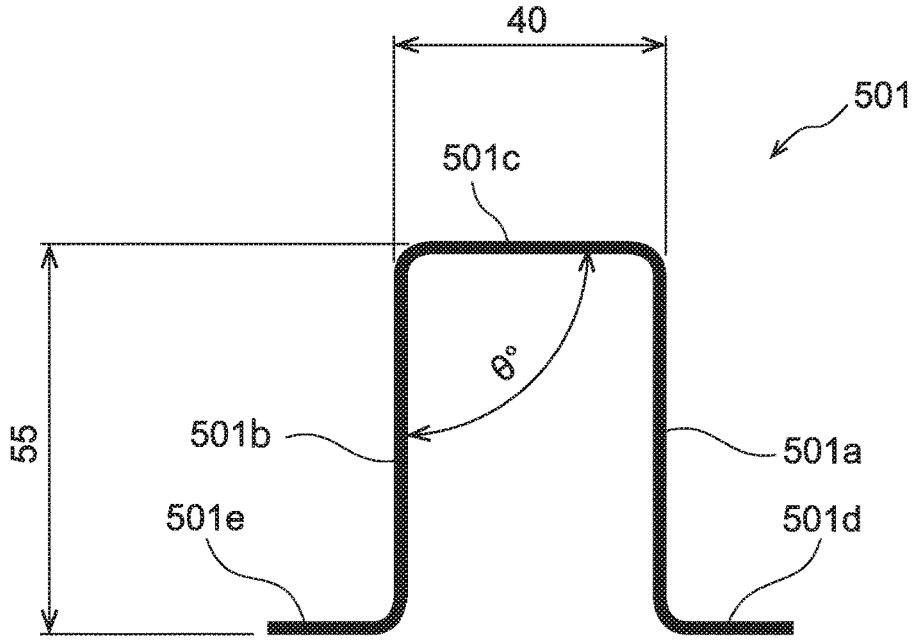
FIG. 17D is a front view of the curving component illustrated in FIG. 17A as viewed from the one end portion.
Figure 18:
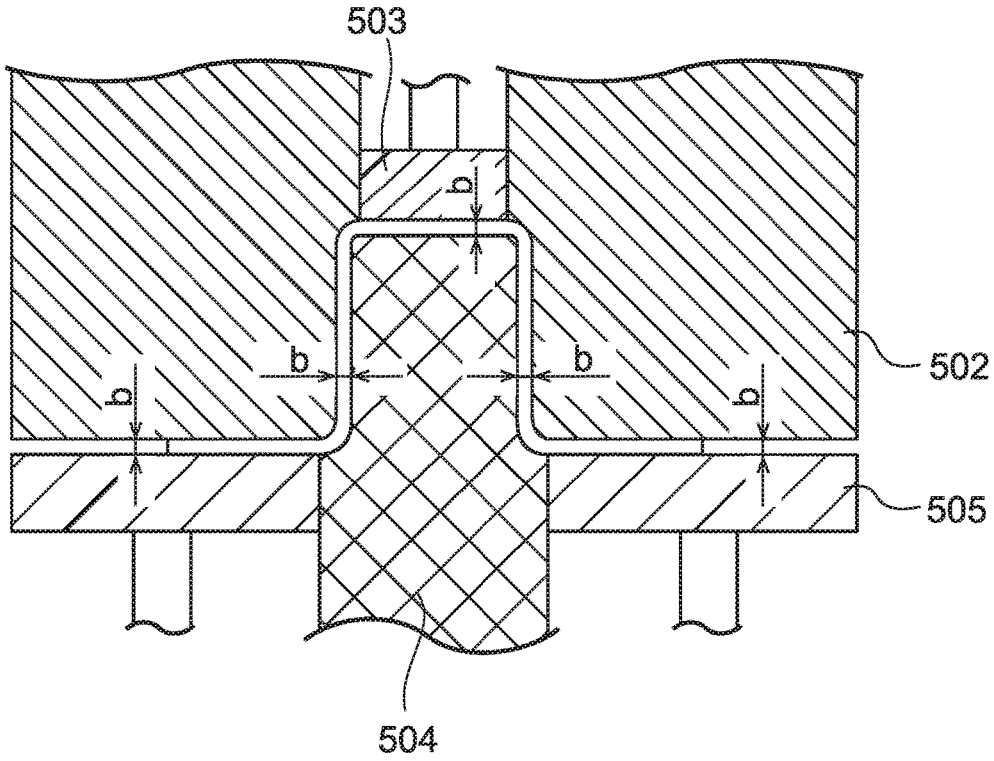
FIG. 18 is a cross-section of a mold, illustrating the clearance b in Table 1.

FIG. 17A is a perspective view illustrating the curving component 501. FIG. 17B is a plan view illustrating the curving component 501 in FIG. 17A, as viewed from above. FIG. 17C is a side view of the curving component 501 in FIG. 17A. FIG. 17D is a cross-section illustrating a cross-section of the curving component 501 taken along the line A-A in FIG. 17C. FIG. 18 is a cross-section of the mold.

TABLE 1

| | CASE | Tensile Strength of Material (MPa) | Sheet Thickness t (mm) | θ (°) | Clearance b (mm) | b/t | Pad Pressure (MPa) | Blank Holder Pressure (MPa) | Creasing |
|---|---|---|---|---|---|---|---|---|---|
| Example | 1 | 980 | 1.8 | 90 | 1.8 | 1.00 | 5.83 | 2.50 | Absent |
| | 2 | 980 | 1.8 | 91 | 1.8 | 1.00 | 5.83 | 2.50 | Absent |
| | 3 | 980 | 1.8 | 92 | 1.8 | 1.00 | 5.83 | 2.50 | Absent |
| | 4 | 980 | 1.8 | 95 | 1.8 | 1.00 | 5.83 | 2.50 | Somewhat present |
| | 5 | 980 | 1.8 | 80 | 1.8 | 1.00 | 5.83 | 2.50 | Somewhat present |
| | 6 | 980 | 1.6 | 90 | 1.8 | 1.13 | 5.83 | 2.50 | Absent |
| | 7 | 980 | 1.4 | 90 | 1.8 | 1.29 | 5.83 | 2.50 | Somewhat present |
| | 8 | 980 | 1.2 | 90 | 1.8 | 1.50 | 5.83 | 2.50 | Somewhat present |
| | 9 | 980 | 1.0 | 90 | 1.8 | 1.80 | 5.83 | 2.50 | Somewhat present |
| | 10 | 440 | 1.6 | 90 | 1.8 | 1.13 | 2.33 | 1.50 | Absent |
| | 11 | 440 | 1.6 | 90 | 1.8 | 1.13 | 1.17 | 1.50 | Absent |
| | 12 | 440 | 1.6 | 90 | 1.8 | 1.13 | 0.58 | 1.50 | Absent |
| | 13 | 400 | 1.6 | 90 | 1.8 | 1.13 | 0.09 | 1.50 | Somewhat present |
| | 14 | 440 | 1.6 | 90 | 1.8 | 1.13 | 3.50 | 1.00 | Absent |
| | 15 | 440 | 1.6 | 90 | 1.8 | 1.13 | 3.50 | 0.75 | Absent |
| | 16 | 440 | 1.6 | 90 | 1.8 | 1.13 | 3.50 | 0.09 | Somewhat present |
| | 17 | 1310 | 1.8 | 90 | 1.8 | 1.00 | 5.83 | 2.50 | Absent |
| | 18 | 590 | 1.6 | 90 | 1.8 | 1.13 | 3.50 | 1.50 | Absent |
| | 19 | 440 | 1.6 | 90 | 1.8 | 1.13 | 2.33 | 1.50 | Absent |

The angle θ in Table 1 is the internal angle θ formed between the vertical walls 501*a*, 501*b* and the top plate 501*c*, as illustrated in FIG. 17D. The clearance b in Table 1 is the gap between the pad 503 and the punch 504, between the die 502 and punch 504, and the die 502 and blank holder 505, as illustrated in FIG. 18.

Each of the Examples 1 to 19 in Table 1 are examples of the present exemplary embodiment. In Table 1, "somewhat present" refers to the occurrence of creasing at an acceptable level. (1) Nos. 1 to 5 examples of cases in which the angle formed between the vertical walls 501*a*, 501*b* and the top plate 501*c* was varied. (2) Nos. 6 to 9 are examples of cases in which the mold clearance, more specifically the sheet thickness t with respect to a fixed clearance b, was varied. (3) Nos. 10 to 13 are examples of cases in which the pressure applied to the pad 503 (pad pressure) was varied. (4) Nos. 14 to 16 are examples of cases in which the pressure applied to the blank holder 505 (holder pressure) was varied. (5) Nos. 17 to 19 are examples of cases in which the tensile strength of the material was varied. The presence or absence of creasing occurrence was investigated in curving components manufactured for each Example.

It can be seen from the above table that unacceptable creasing of the components did not occur in the curving component 501 within the range of parameters investigated.

Modified Examples of the Hat-Shaped Cross-Section Component

Next, explanation follows regarding hat-shaped cross-section components formed with varied settings (shape and the like) of the blank holder 505, the die 502, the punch 504, and the pad 503 of the hat-shaped cross-section component manufacturing apparatus 500.

A curving component 100 illustrated in FIG. 19A to FIG. 19D, serving as a hat-shaped cross-section component, has the characteristics of curving in a substantially S-shape in plan view, but not curving as viewed from the side. The curving component 100 is configured including a top plate 102, vertical walls 104, 106 provided extending parallel to each other following ridge lines 102*a*, 102*b* of the top plate 102, and outward extending flanges 108*a*, 108*b* formed at leading ends of the vertical walls 104, 106.

Figure 19A:
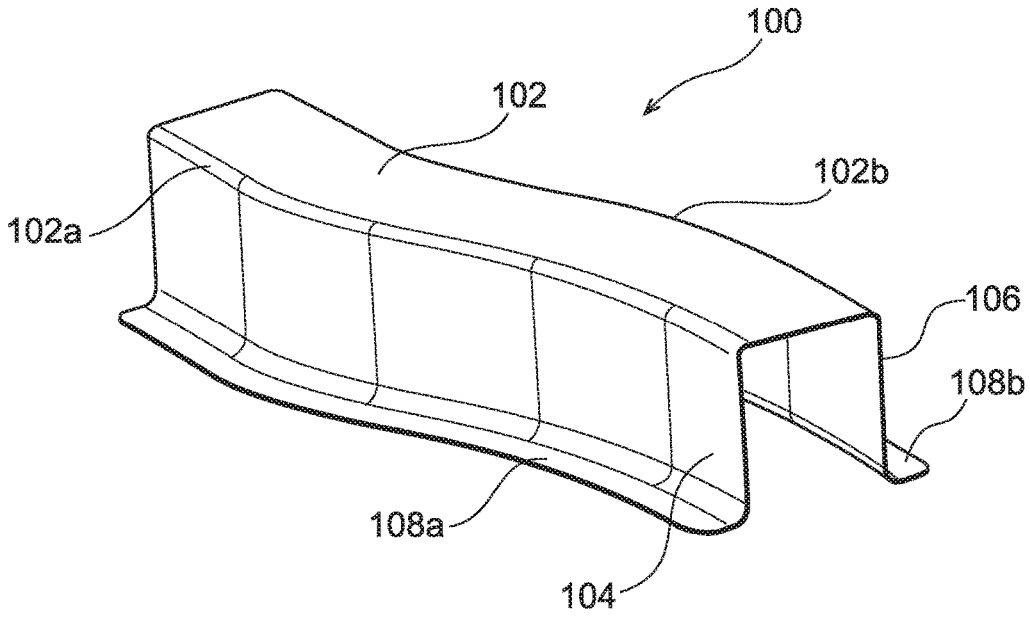
FIG. 19A is a perspective view illustrating another curving component manufactured by a hat-shaped cross-section component manufacturing apparatus according to an exemplary embodiment of the present invention.
Figure 19B:
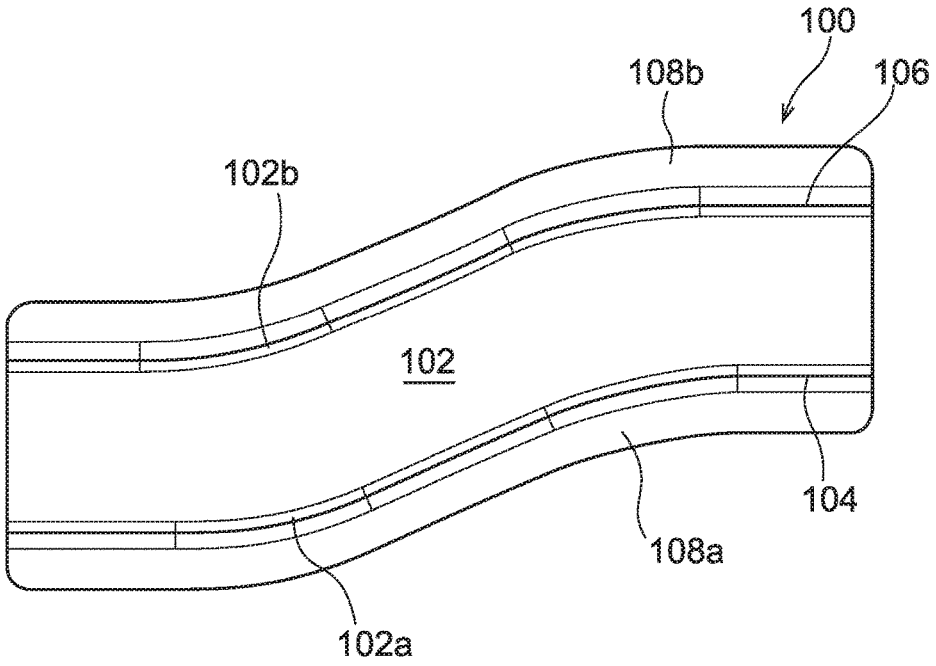
FIG. 19B is a plan view of the curving component in FIG. 19A, as viewed from above.
Figure 19C:
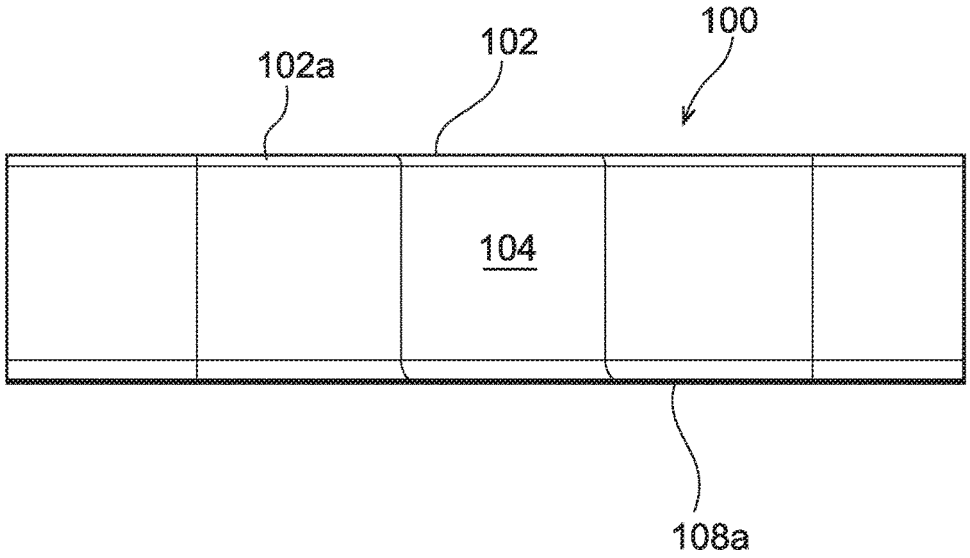
FIG. 19C is a side view of the curving component in FIG. 19A.
Figure 19D:
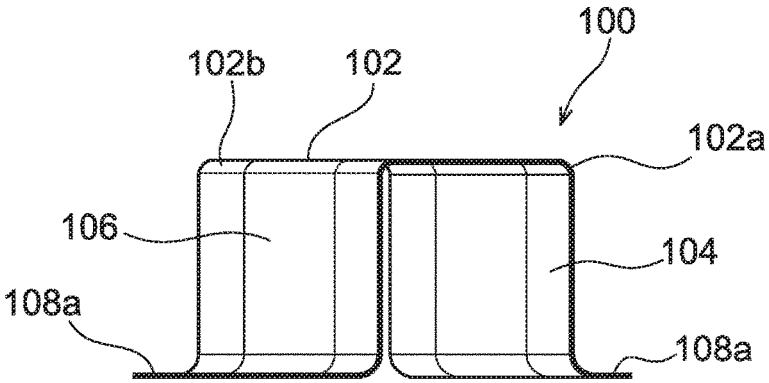
FIG. 19D is a front view of the curving component in FIG. 19A, as viewed from one end portion.
Figure 20A:
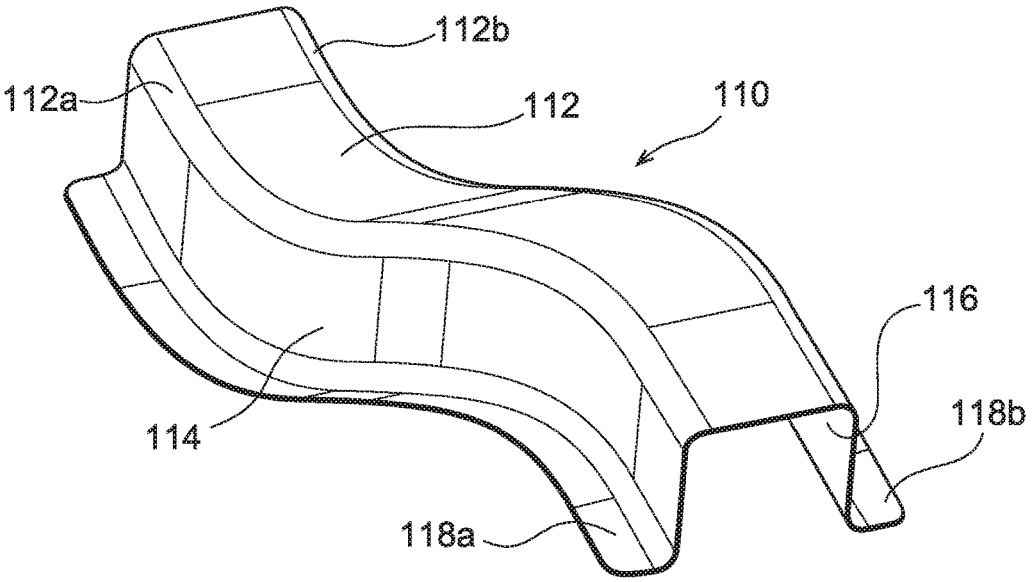
FIG. 20A is a perspective view illustrating another curving component manufactured by a hat-shaped cross-section component manufacturing apparatus according to an exemplary embodiment of the present invention.
Figure 20B:
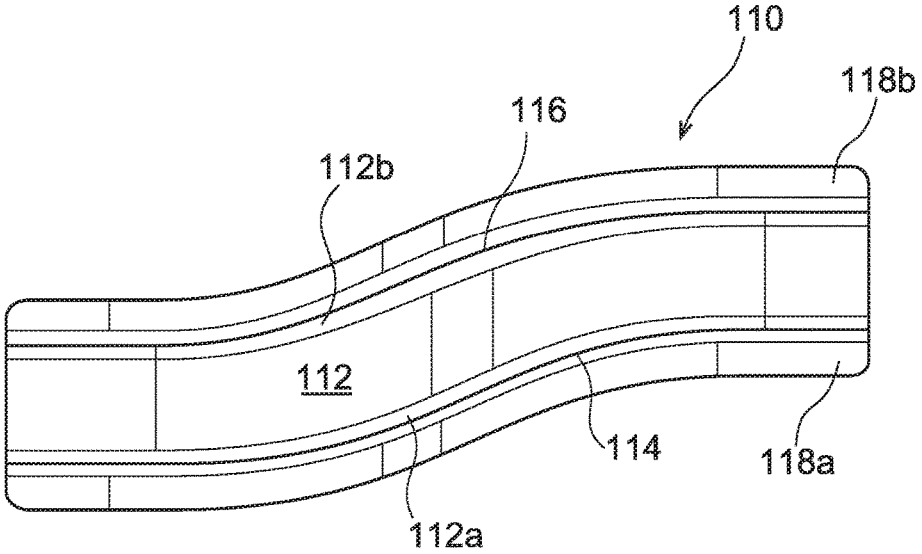
FIG. 20B is a plan view of the curving component in FIG. 20A, as viewed from above.
Figure 20C:
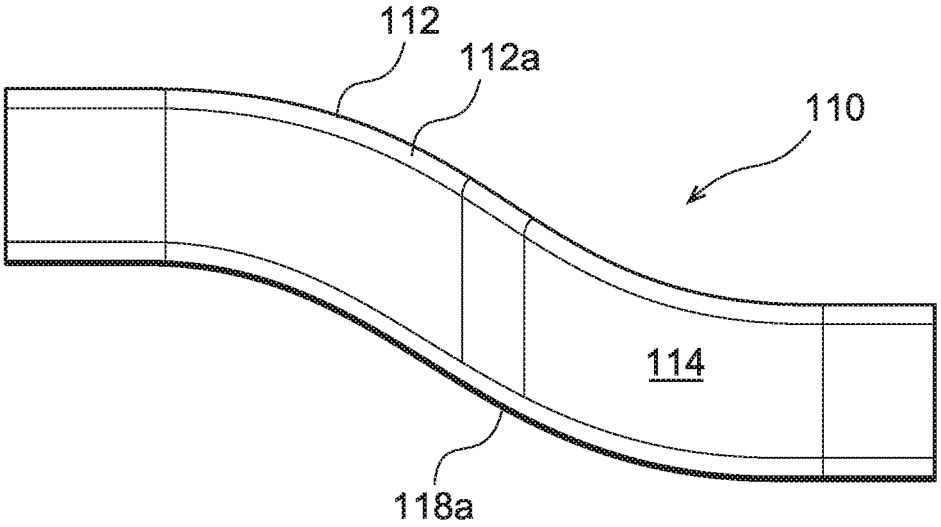
FIG. 20C is a side view of the curving component in FIG. 20A.
Figure 20D:
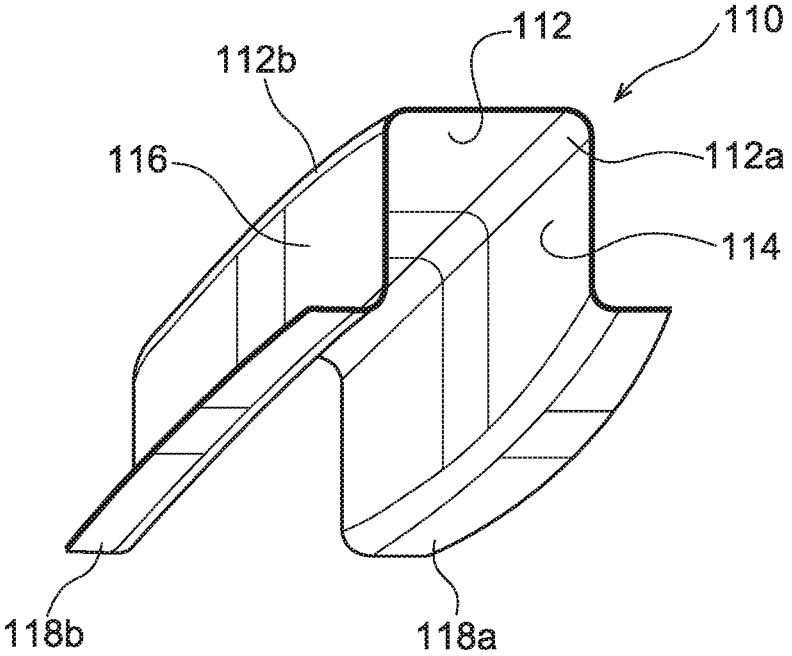
FIG. 20D is a perspective view of the curving component in FIG. 20A, as viewed from a bottom face side.
Figure 21A:
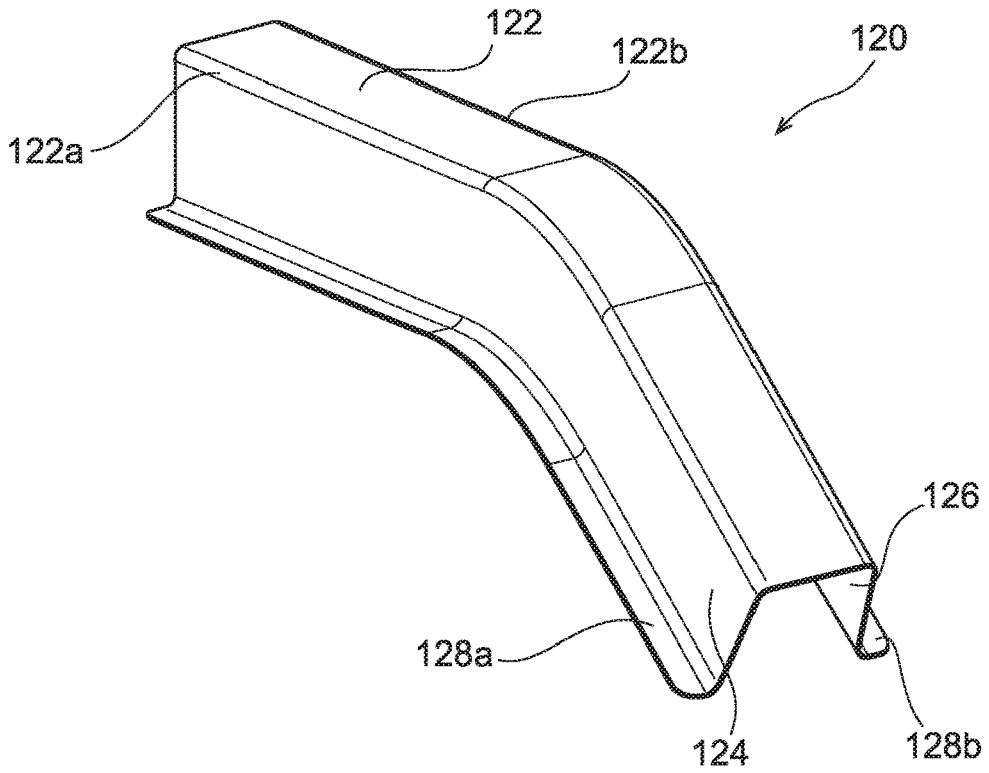
FIG. 21A is a perspective view illustrating another curving component manufactured by a hat-shaped cross-section component manufacturing apparatus according to an exemplary embodiment of the present invention.
Figure 21B:
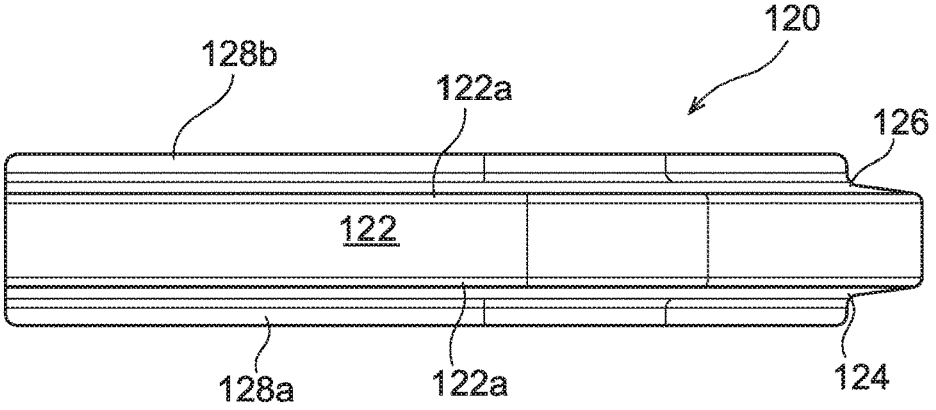
FIG. 21B is a plan view of the curving component illustrated in FIG. 21A, as viewed from above.
Figure 21C:
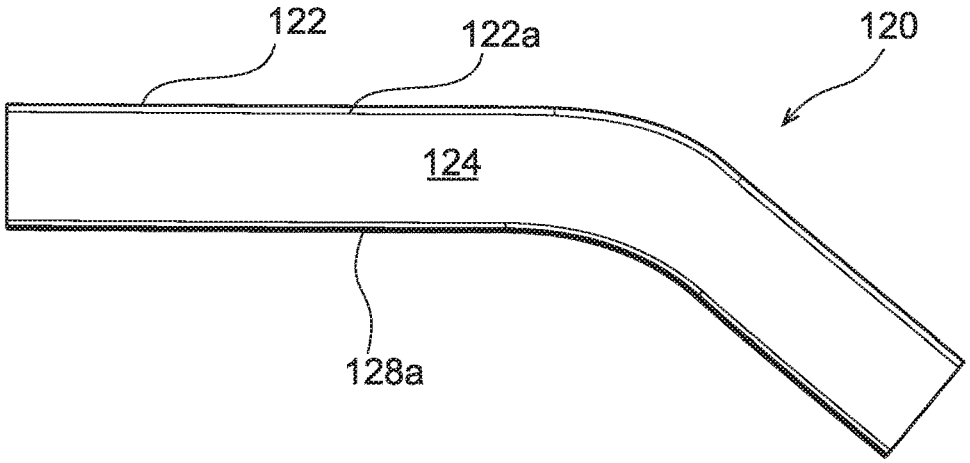
FIG. 21C is a side view of the curving component illustrated in FIG. 21A.
Figure 21D:
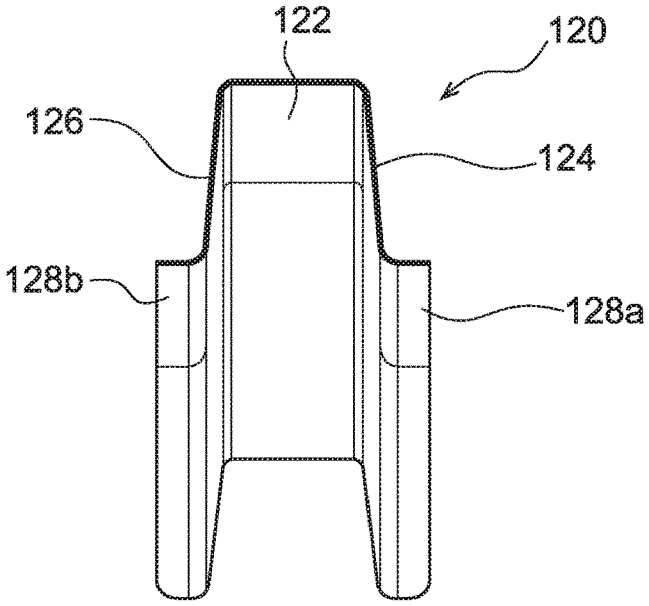
FIG. 21D is a front view of the curving component illustrated in FIG. 21A, as viewed from the left side.
Figure 22A:
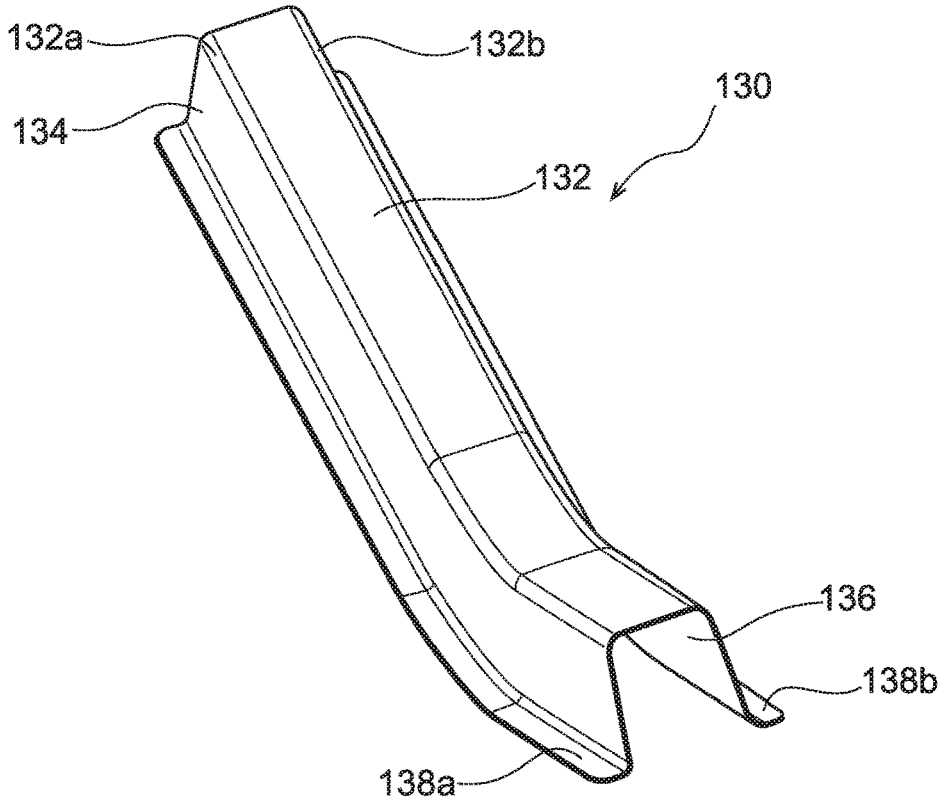
FIG. 22A is a perspective view of another curving component manufactured by a hat-shaped cross-section component manufacturing apparatus according to an exemplary embodiment of the present invention.
Figure 22B:
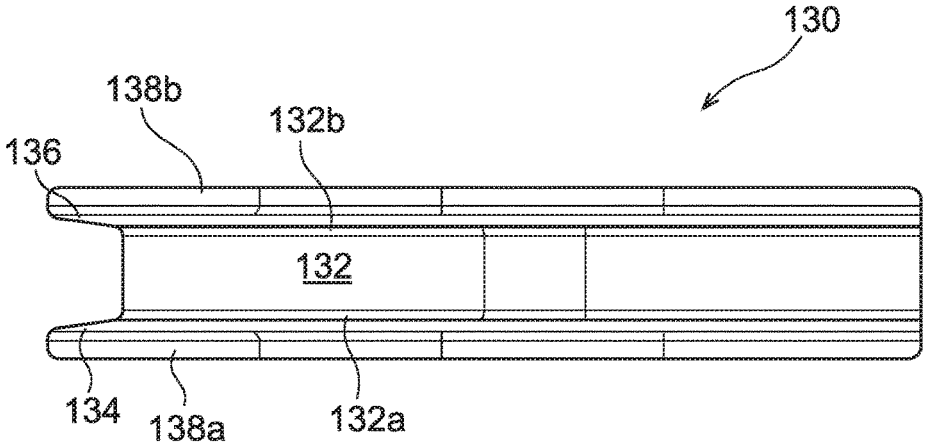
FIG. 22B is a plan view of the curving component in FIG. 22A, as viewed from above.
Figure 22C:
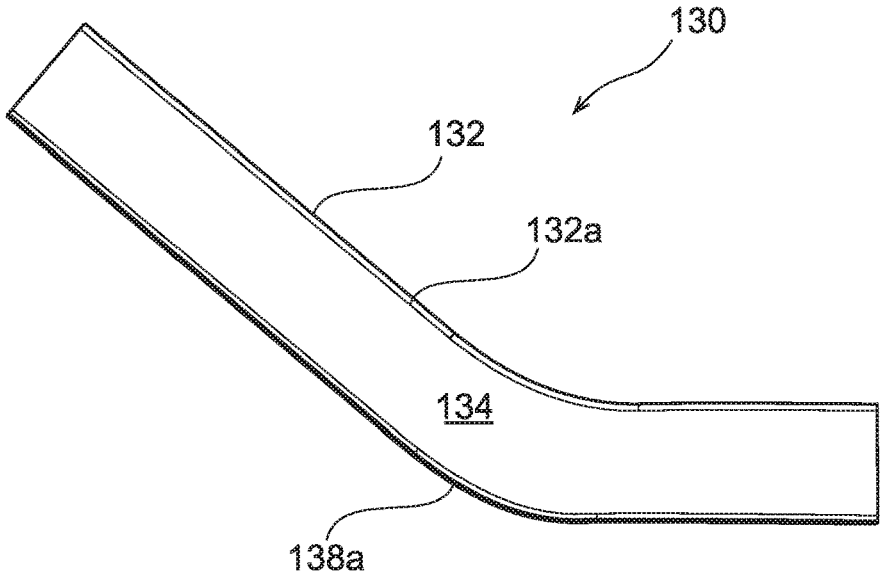
FIG. 22C is a side view of the curving component in FIG. 22A.
Figure 22D:
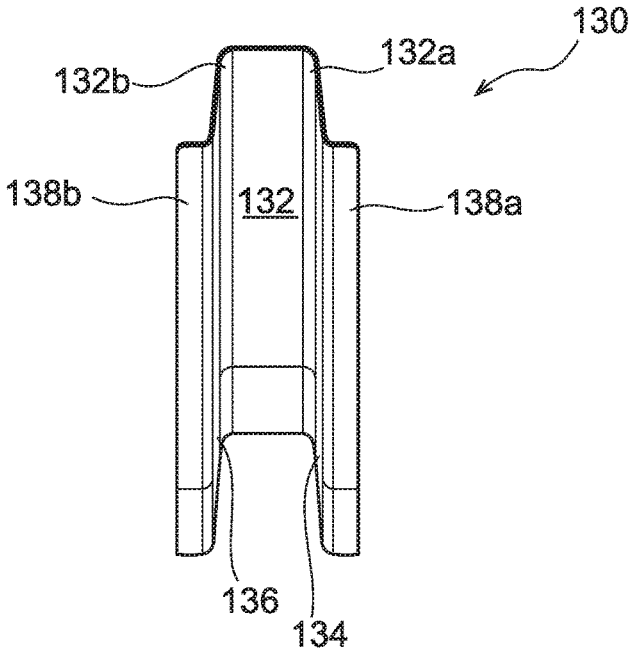
FIG. 22D is a front view of the curving component in FIG. 22A as viewed from the left side.
Figure 23A:
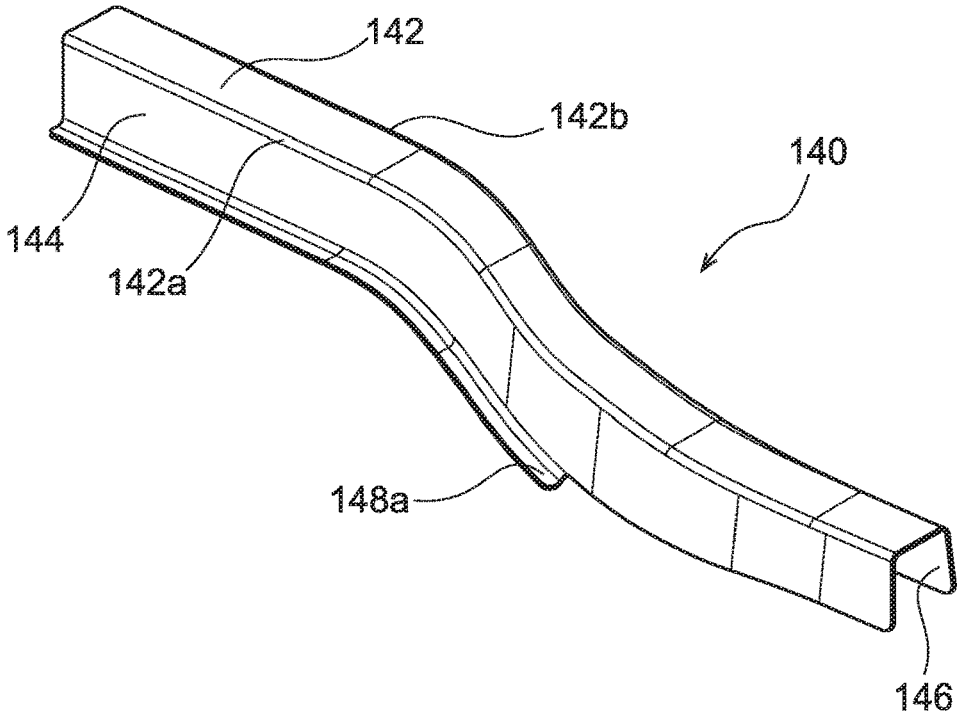
FIG. 23A is a perspective view of another curving component manufactured by a hat-shaped cross-section component manufacturing apparatus according to an exemplary embodiment of the present invention.
Figure 23B:
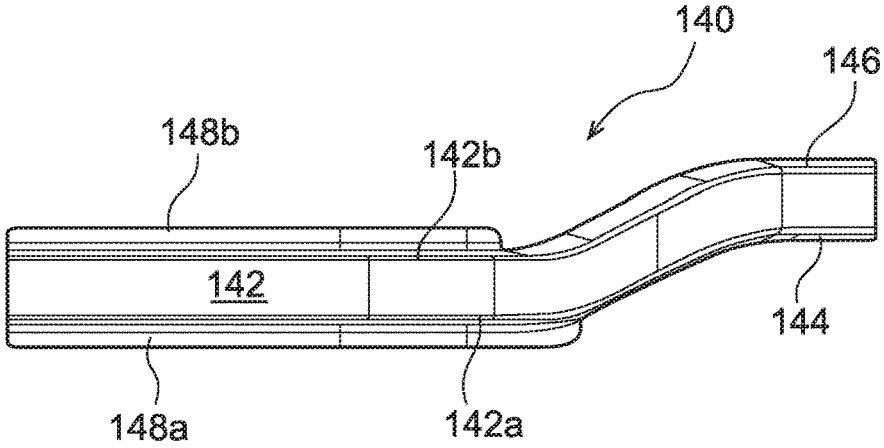
FIG. 23B is a plan view of the curving component in FIG. 23A, as viewed from above.
Figure 23C:
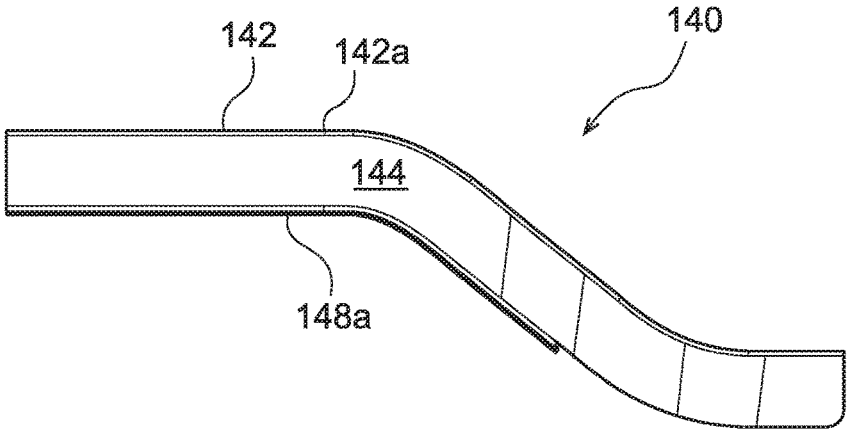
FIG. 23C is a side view of the curving component in FIG. 23A.
Figure 23D:
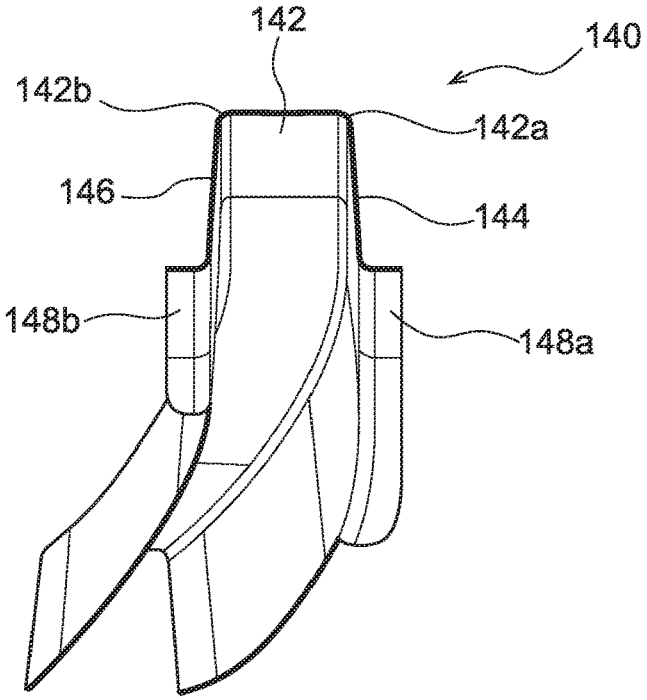
FIG. 23D is a perspective view of the curving component in FIG. 23A, as viewed from a bottom face side.

As illustrated in FIG. 19B, the top plate 102 is configured by a flat plate curving in a substantially S-shape within a plane parallel to the page in FIG. 19B. The outward extending flanges 108*a*, 108*b* are provided extending substantially parallel to the top plate 102, and are formed by flat plates curving in substantially S-shapes. The vertical walls 104, 106 are configured by curving plates that curve in substantially S-shapes in the thickness direction of the vertical walls 104, 106, and that are disposed parallel to each other.

As illustrated in FIG. 20A to FIG. 20D, a curving component 110, serving as a hat-shaped cross-section component, has the characteristics of curving in a substantially S-shape in plan view and also curving in a substantially S-shape as viewed from the side. The curving component 110 is configured including a top plate 112, vertical walls 114, 116 provided extending parallel to each other following ridge lines 112*a*, 112*b* of the top plate 112, and outward extending flanges 118*a*, 118*b* formed at leading ends of the vertical walls 114, 116. The top plate 112 is formed by a curving plate curving in a substantially S-shape in the thickness direction of the top plate 112. The outward extending flanges 118*a*, 118*b* are provided extending substantially parallel to the top plate 112, and, similarly to the top plate 112, are formed by curving plates that curve in substantially S-shapes in the thickness direction of the flanges 118*a*, 118*b*. The vertical walls 114, 116 are also configured from curving plates that curve in substantially S-shapes in the thickness direction of the vertical walls 114, 116.

As illustrated in FIG. 21A to FIG. 21D, a curving component 120, serving as a hat-shaped cross-section component, has the characteristics of having a length direction intermediate portion that curves in an arc shape in side view. The curving component 120 is configured including a top plate 122, vertical walls 124, 126 provided extending parallel to each other following ridge lines 122*a*, 122*b* of the top plate 122, and outward extending flanges 128*a*, 128*b* formed at leading ends of the vertical walls 124, 126.

The top plate 122 is configured by a curving plate that curves in the thickness direction of the top plate 122, and the outward extending flanges 128*a*, 128*b* are configured by curving plates provided extending substantially parallel to the top plate 122. The vertical walls 124, 126 are configured by flat plates parallel to the page in FIG. 21C.

As illustrated in FIG. 22A to FIG. 22D, as viewed from the side, a curving component 130, serving as a hat-shaped cross-section component, has the opposite curvature to the curving component 120 in FIG. 21A to FIG. 21D. The curving component 130 is configured including a top plate 132, vertical walls 134, 136 provided extending parallel to each other following ridge lines 132*a*, 132*b* of the top plate 132, and outward extending flanges 138*a*, 138*b* formed at leading ends of the vertical walls 134, 136. The top plate 132 is configured by a curving plate that curves in the thickness direction of the top plate 132, and the outward extending flanges 138*a*, 138*b* are configured by curving plates provided extending substantially parallel to the top plate 132. The vertical walls 134, 136 are configured by flat plates parallel to the page in FIG. 22C.

As illustrated in FIG. 23A to FIG. 23D, a curving component 140, serving as a hat-shaped cross-section component, is configured including a top plate 142, vertical walls 144, 146 provided extending parallel to each other following ridge lines 142*a*, 142*b* of the top plate 142, and outward extending flanges 148*a*, 148*b* formed at leading ends of the vertical walls 144, 146. The top plate 142 is configured by a curving plate that curves in a substantially S-shape in the thickness direction of the top plate 142. The outward extending flanges 148*a*, 148*b* are configured by substantially S-shaped curving plates provided extending substantially parallel to the top plate 142. The vertical walls 144, 146 are also configured by curving plates that curve in substantially S-shapes in the thickness direction of the vertical walls 144, 146. In the curving component 140, the flanges 148*a*, 148*b* are not provided extending along the entire length of the vertical walls 144, 146. Namely, the vertical walls 144, 146 include portions where the flanges 148*a*, 148*b* are not present. In FIG. 23A to FIG. 23D, the length of the flanges 148*a*, 148*b* is a shorter length than a length of the vertical walls 144, 146 along lower edge portions of the vertical walls 144, 146 from one end portion of the curving component 140. The flange 148*a* has a longer dimension than the flange 148*b*.

Figure 24A:
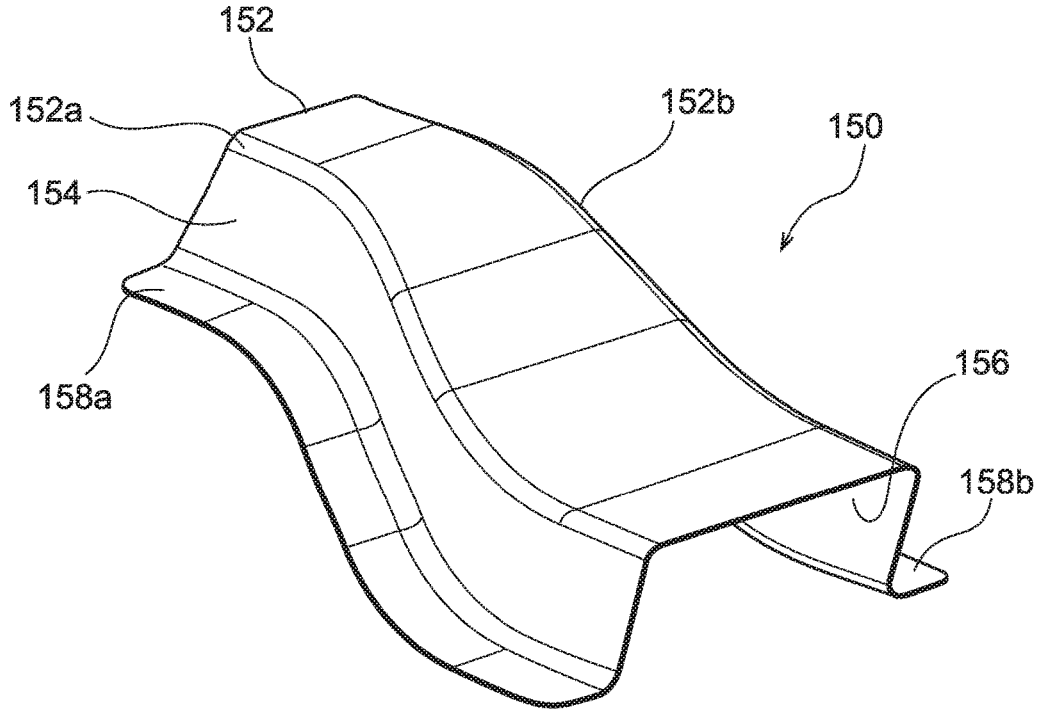
FIG. 24A is a perspective view illustrating another curving component manufactured by a hat-shaped cross-section component manufacturing apparatus according to an exemplary embodiment of the present invention.
Figure 24B:
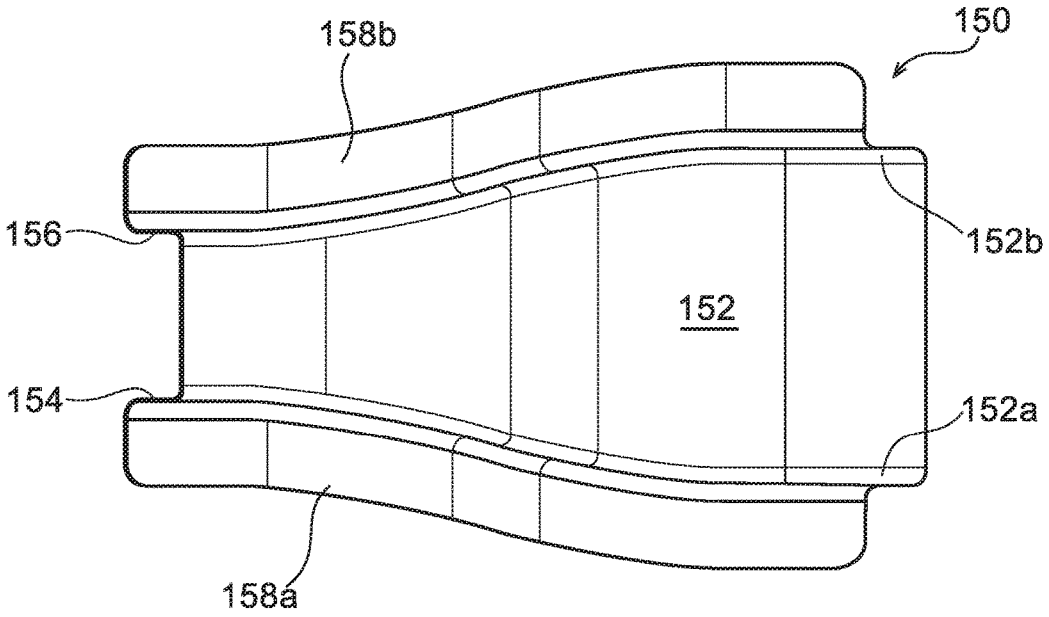
FIG. 24B is a plan view of the curving component in FIG. 24A as viewed from above.
Figure 24C:
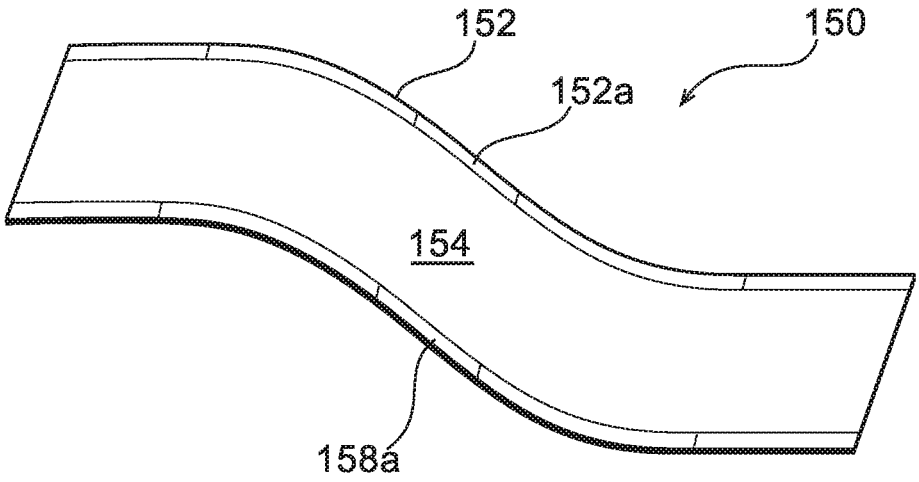
FIG. 24C is a side view of the curving component in FIG. 24A.
Figure 24D:
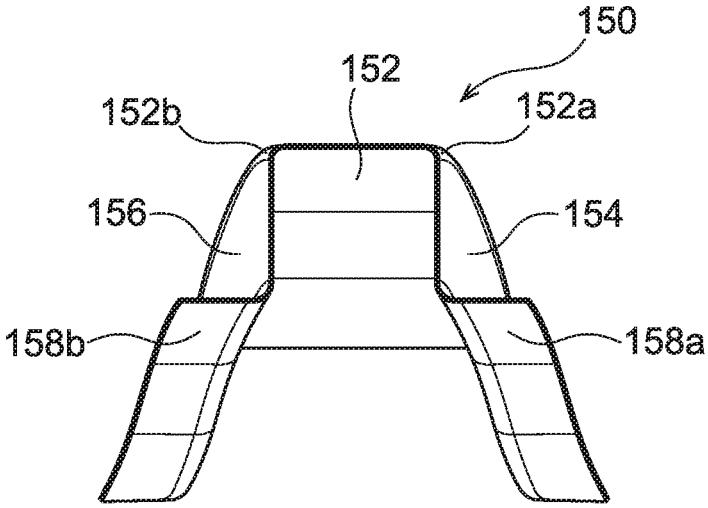
FIG. 24D is a perspective view of the curving component in FIG. 24A, as viewed from a bottom face side.

As illustrated in FIG. 24A to FIG. 24D, a curving component 150, serving as a hat-shaped cross-section component, curves in a substantially S-shape as viewed from the side, and gradually widens on progression toward one length direction side in plan view. The curving component 150 is configured including a top plate 152, vertical walls 154, 156 provided extending parallel to each other following ridge lines 152*a*, 152*b* of the top plate 152, and flanges 158*a*, 158*b* formed at leading ends of the vertical walls 154, 156. The top plate 152 is configured by a curving plate curving in a substantially S-shape in the thickness direction of the top plate 152. The flanges 158*a*, 158*b* are configured by curving plates provided extending substantially parallel to the top plate 152. Each of the vertical walls 154, 156 is configured by a flat plate that curves in a substantially S-shape as viewed from the side, as illustrated in FIG. 24C. The width of the top plate 152 gradually increases on progression toward an end portion on the one side of the curving component 150. The vertical wall 154 and the vertical wall 156 gradually become further away from each other on progression toward the end portion on the one side of the curving component 150.

Figure 25A:
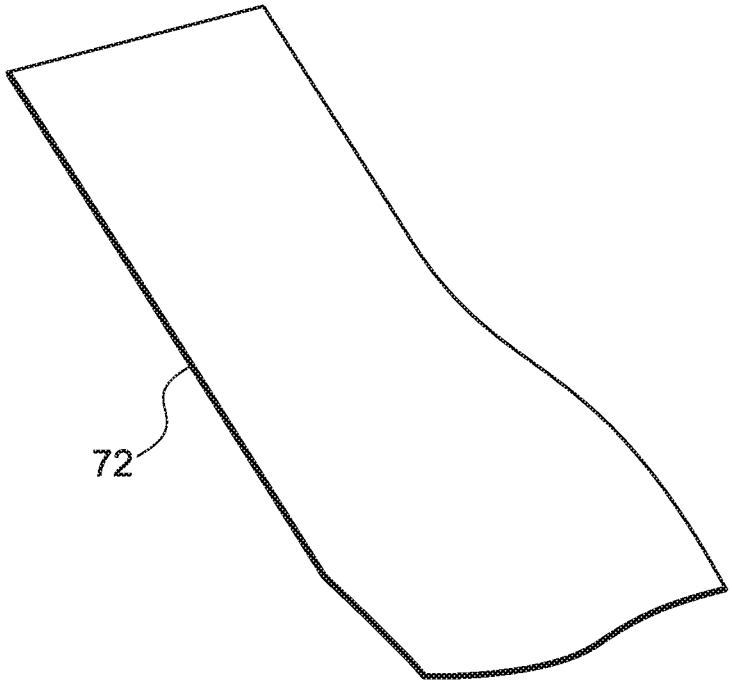
FIG. 25A is a perspective view illustrating a metal stock sheet before pre-processing.
Figure 25B:
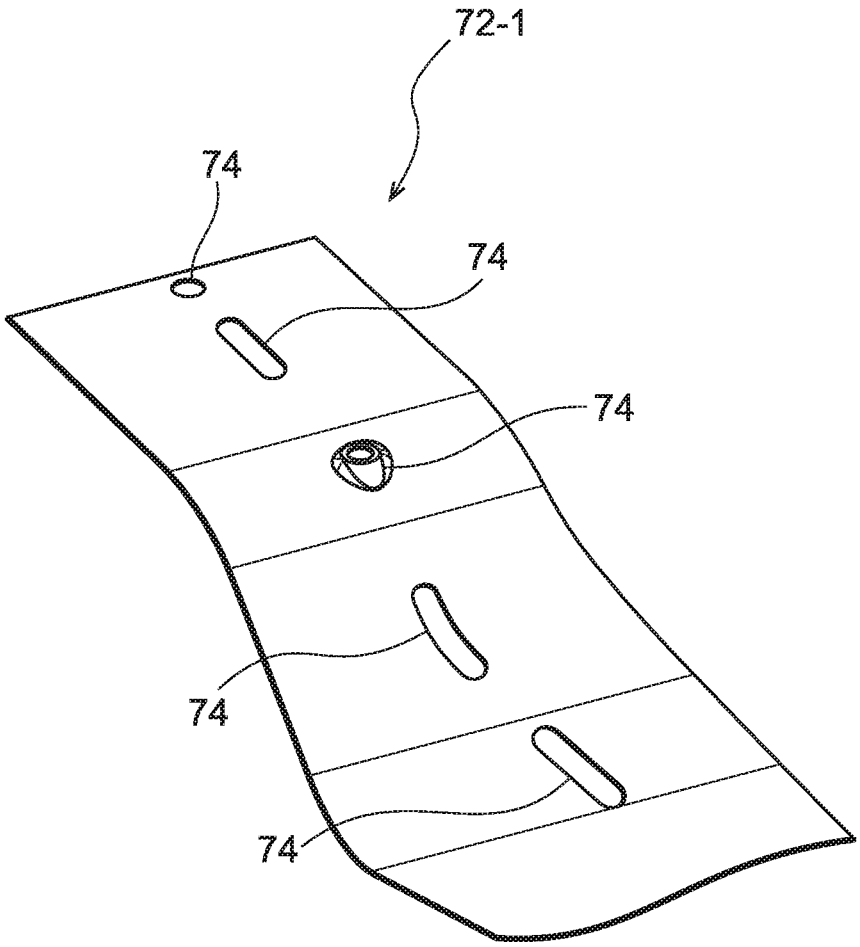
FIG. 25B is a perspective view illustrating a pre-processed metal stock sheet.
Figure 25C:
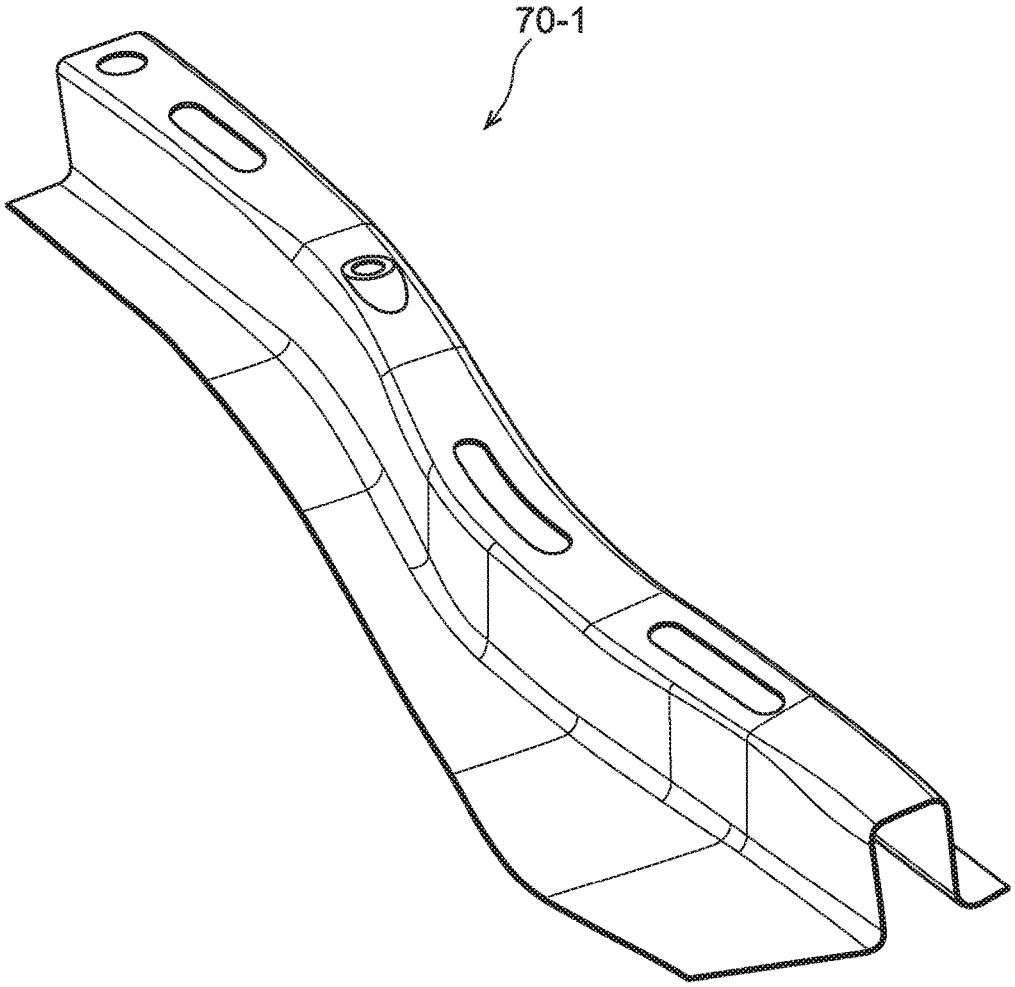
FIG. 25C is a perspective view illustrating a curving component formed from the pre-processed metal stock sheet.
Figure 25D:
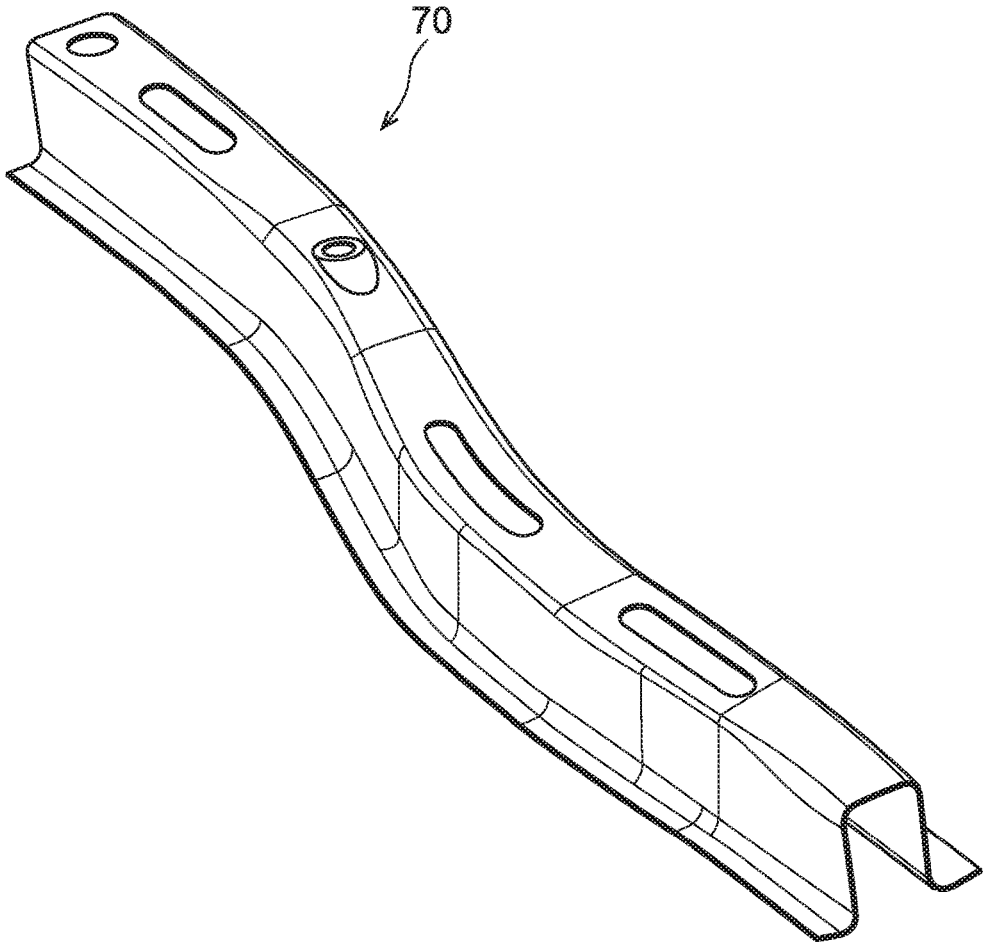
FIG. 25D is a perspective view illustrating a state in which the curving component illustrated in FIG. 25C has been trimmed.

A curving component 70 illustrated in FIG. 25D, serving as a hat-shaped cross-section component, is formed by press working, and then trimming, a pre-processed metal sheet formed by performing pre-processing a metal stock sheet.

A pre-processed metal sheet 72-1 is formed by forming plural protrusion shaped portions 74, illustrated in FIG. 25B, in a rectangular shaped metal stock sheet 72, illustrated in FIG. 25A. Next, the pre-processed metal sheet 72-1 is press worked by the hat-shaped cross-section component manufacturing apparatus 500 (see FIG. 5) described above, thereby forming a curving component 70-1, as illustrated in FIG. 25C, that includes portions that are not wanted in the manufactured product. The unwanted portions of the curving component 70-1 are then trimmed to form the curving component 70 illustrated in FIG. 25D.

Note that as illustrated in FIG. 25C, when the pre-processed metal sheet 72-1 including the protrusion shaped portions 74 is formed by using the hat-shaped cross-section component manufacturing apparatus 500 (see FIG. 5), a top plate portion is pressed against the punch 504 by the pad 503, and it is conceivable that the pre-processed protrusion shaped portions 74 could be deformed. Accordingly, the pad 503 and the punch 504 are preferably provided with shapes respectively corresponding to the protrusion shaped portions 74 to enable pressing and gripping without deforming the protrusion shaped portions 74.

Explanation has been given above regarding examples in which the curving hat-shaped cross-section components such as the curving component 501 are formed using the hat-shaped cross-section component manufacturing apparatus 500 (see FIG. 5). However, the present invention is not limited thereto. For example, the hat-shaped cross-section component manufacturing apparatus 500 may be used to form hat-shaped cross-section components that have a uniform cross-section along the length direction, and do not curve in side view or in plan view.

Explanation has been given regarding exemplary embodiments of the present invention; however the present invention is not limited to the above, and obviously various modifications may be implemented other than the above, within a range not departing from the spirit of the present invention.

The entire content of Japanese Patent Application No. 2013-197282, filed on Sep. 24, 2013, is incorporated by reference in the present specification.

The invention claimed is:

1. A hat-shaped cross-section component manufacturing apparatus comprising:

a die that includes a forming face that presses both side portions of a metal sheet, and that includes an opening disposed between both side portions of the forming face of the die;

a punch that is disposed facing the opening of the die, wherein the punch is disposed inside the opening when a mold is closed, and wherein the punch includes a forming face that presses a central portion of the metal sheet;

a pad that is disposed inside the opening formed in the die, wherein the pad includes a forming face that presses and grips the central portion of the metal sheet against the punch when the mold is closed so as to configure a forming face corresponding to the forming face of the punch;

a holder that is disposed facing the die, wherein the holder includes a forming face that presses and grips both side portions of the metal sheet against the die when the mold is closed so as to configure a forming face corresponding to the forming face of the die; and a pressure limiting device that limits a formed hat-shaped cross-section component with a hat-shaped cross-section profile from being pressed between the pad and the holder during demolding, wherein the pressure limiting device limits relative movement of the holder toward a die side with respect to the punch, when the punch disposed inside the opening and the die are separated from each other.

2. A hat-shaped cross-section component manufacturing apparatus comprising:

a die that includes a forming face that presses both side portions of a metal sheet, and that includes an opening disposed between both side portions of the forming face of the die;

a punch that is disposed facing the opening of the die, wherein the punch is disposed inside the opening when a mold is closed, and wherein the punch includes a forming face that presses a central portion of the metal sheet;

a pad that is disposed inside the opening formed in the die, wherein the pad includes a forming face that presses and grips the central portion of the metal sheet against the punch when the mold is closed so as to configure a forming face corresponding to the forming face of the punch;

a holder that is disposed facing the die, wherein the holder includes a forming face that presses and grips both side portions of the metal sheet against the die when the mold is closed so as to configure a forming face corresponding to the forming face of the die; and a pressure limiting device that limits a formed hat-shaped cross-section component with a hat-shaped cross-section profile from being pressed between the pad and the holder during demolding, wherein the pressure limiting device includes a coupling portion that fixes a positional relationship between the pad and the holder by coupling the pad and the holder together.

3. A hat-shaped cross-section component manufacturing apparatus comprising:

a die that includes a forming face that presses both side portions of a metal sheet, and that includes an opening disposed between both side portions of the forming face of the die;

a punch that is disposed facing the opening of the die, wherein the punch is disposed inside the opening when a mold is closed, and wherein the punch includes a forming face that presses a central portion of the metal sheet;

a pad that is disposed inside the opening formed in the die, wherein the pad includes a forming face that presses and grips the central portion of the metal sheet against the punch when the mold is closed so as to configure a forming face corresponding to the forming face of the punch;

a holder that is disposed facing the die, wherein the holder includes a forming face that presses and grips both side portions of the metal sheet against the die when the mold is closed so as to configure a forming face corresponding to the forming face of the die; and a pressure limiting device that limits a formed hat-shaped cross-section component with a hat-shaped cross-section profile from being pressed between the pad and the holder during demolding, wherein the pressure limiting device includes a holder side limiting section that limits movement of the holder toward a die side during demolding, and the holder side limiting section is a fixing tool that fixes the holder to the punch.

4. A hat-shaped cross-section component manufacturing apparatus comprising:

a die that includes a forming face that presses both side portions of a metal sheet, and that includes an opening disposed between both side portions of the forming face of the die;

a punch that is disposed facing the opening of the die, wherein the punch is disposed inside the opening when a mold is closed, and wherein the punch includes a forming face that presses a central portion of the metal sheet;

a pad that is disposed inside the opening formed in the die, wherein the pad includes a forming face that presses and grips the central portion of the metal sheet against the punch when the mold is closed so as to configure a forming face corresponding to the forming face of the punch;

a holder that is disposed facing the die, wherein the holder includes a forming face that presses and grips both side portions of the metal sheet against the die when the mold is closed so as to configure a forming face corresponding to the forming face of the die; and a pressure limiting device that limits a formed hat-shaped cross-section component with a hat-shaped cross-section profile from being pressed between the pad and the holder during demolding, wherein the pressure limiting device includes a pad side limiting section that limits movement of the pad toward a punch side during demolding, and the pad side limiting section is a fixing tool that fixes the pad to the die.

* * * * *